US011517087B2

(12) United States Patent
Soria

(10) Patent No.: US 11,517,087 B2
(45) Date of Patent: Dec. 6, 2022

(54) SYSTEMS FOR RETAINING ABSORBENT ARTICLES AND COLLECTION KITS

(71) Applicant: Tamara Soria, Chardon, OH (US)

(72) Inventor: Tamara Soria, Chardon, OH (US)

(73) Assignee: Tamara Soria, Chardon, OH (US)

( * ) Notice: Subject to any disclaimer, the term of this patent is extended or adjusted under 35 U.S.C. 154(b) by 45 days.

(21) Appl. No.: 17/179,745

(22) Filed: Feb. 19, 2021

(65) Prior Publication Data

US 2021/0177116 A1 Jun. 17, 2021

Related U.S. Application Data

(63) Continuation-in-part of application No. 15/905,200, filed on Feb. 26, 2018, now Pat. No. 11,040,821,
(Continued)

(51) Int. Cl.
*A45C 11/00* (2006.01)
*A45D 33/26* (2006.01)
(Continued)

(52) U.S. Cl.
CPC ..... *A45C 11/008* (2013.01); *A45D 33/26* (2013.01); *A47K 5/1201* (2013.01); *A47K 10/20* (2013.01); *A45C 2011/007* (2013.01)

(58) Field of Classification Search
CPC .... A47K 10/20; A47K 5/1201; A47K 10/421; A47K 10/46; A47K 10/42; A47K 10/24;
(Continued)

(56) References Cited

U.S. PATENT DOCUMENTS 2,347,823 A 5/1944 Goodman et al.
3,976,049 A 8/1976 Yamashita et al.
(Continued)

FOREIGN PATENT DOCUMENTS

DE 202011004147 6/2011
EP 0501260 9/1992
(Continued)

OTHER PUBLICATIONS

International Search Report and Written Opinion; dated Feb. 2, 2017; PCT/US16/50939; 12 pages.
(Continued)

*Primary Examiner* — Rafael A Ortiz
(74) *Attorney, Agent, or Firm* — Mark E. Bandy; Rankin Hill & Clark, LLP

(57) ABSTRACT

A personal care collection kit is described. The kit may include a sanitizer and an absorbent material. The components are housed in a lined enclosure. A personal care article can be withdrawn from the collection kit, used, and discarded back into an interior region of the enclosure of the collection kit. A sanitizer can be expelled from within the enclosure and can easily be dispensed by a one hand function. The sanitizer is spread on a user's hand discreetly inside the liner and enclosure. The hand can be dried with the absorbent material again by a one hand function. The lining keeps the wet, dry, powder, or similar type sanitizer substances from contacting the inside of a user's pocket or adjacent body part, substrate or the like.

12 Claims, 10 Drawing Sheets

Related U.S. Application Data which is a continuation-in-part of application No. 14/864,438, filed on Sep. 24, 2015, now abandoned.

(60) Provisional application No. 62/055,707, filed on Sep. 26, 2014.

(51) Int. Cl.
*A47K 5/12* (2006.01)
*A47K 10/20* (2006.01)

(58) Field of Classification Search
CPC .... A45D 33/26; A45D 8/36; A45C 2011/007; A45C 2005/008; A45C 11/00; A45C 11/008; A45C 2013/226; B65D 37/00; B65D 83/0835; B65D 77/02; B65D 67/02; B65D 83/08
USPC ... 206/581, 823, 1.5, 549, 223, 233, 229, 38
See application file for complete search history.

(56) References Cited

U.S. PATENT DOCUMENTS

| | | | | |
|---|---|---|---|---|
| 4,185,753 | A | 1/1980 | Leto | |
| 4,401,233 | A | 8/1983 | Frey | |
| 4,458,810 | A | 7/1984 | Mahoney | |
| 4,498,591 | A | 2/1985 | Smith, II | |
| 4,513,862 | A | 4/1985 | Mallow | |
| 4,536,889 | A | 8/1985 | Taylor et al. | |
| 4,556,146 | A | 12/1985 | Swanson et al. | |
| 4,796,790 | A | 1/1989 | Hamilton | |
| 4,969,248 | A | 11/1990 | Marks | |
| 4,979,613 | A | 12/1990 | McLaughlin et al. | |
| 5,076,465 | A | 12/1991 | Lawson | |
| 5,127,545 | A | 7/1992 | French | |
| 5,242,057 | A | 9/1993 | Cook et al. | |
| 5,295,579 | A | 3/1994 | Focke et al. | |
| 5,425,975 | A | 6/1995 | Koiso et al. | |
| 5,439,104 | A * | 8/1995 | Wolska-Klis | G02C 13/006 221/96 |
| 5,447,227 | A | 9/1995 | Kosberg | |
| 5,468,236 | A | 11/1995 | Everhart et al. | |
| 5,503,332 | A | 4/1996 | Glenn | |
| 5,524,759 | A | 6/1996 | Herzberg et al. | |
| 5,938,013 | A | 8/1999 | Palumbo et al. | |
| 5,979,822 | A | 11/1999 | Morand et al. | |
| 6,012,572 | A | 1/2000 | Heathcock et al. | |
| 6,257,473 | B1 | 7/2001 | Ringelstetter | |
| 6,427,839 | B1 | 8/2002 | Helfer-Grand | |
| 6,550,635 | B1 | 4/2003 | King et al. | |
| 6,561,378 | B1 | 5/2003 | Roessler et al. | |
| 6,575,383 | B2 | 6/2003 | Dobler et al. | |
| 7,007,820 | B1 | 3/2006 | Cumer | |
| 7,178,671 | B2 | 2/2007 | Nichols et al. | |
| 7,416,083 | B2 | 8/2008 | Bando | |
| 7,497,351 | B2 * | 3/2009 | Amundson | A47K 10/421 221/96 |
| 7,669,736 | B2 | 3/2010 | Harper | |
| 7,699,166 | B2 | 4/2010 | Gauger et al. | |
| 8,517,171 | B1 | 8/2013 | Delgado | |
| 8,776,272 | B1 | 7/2014 | Straus et al. | |
| 9,259,365 | B2 | 2/2016 | Komatsubara et al. | |
| 9,527,623 | B1 * | 12/2016 | Padden | A45D 44/18 |
| 9,750,167 | B2 * | 8/2017 | Nash | H05K 9/0047 |
| 10,301,060 | B2 * | 5/2019 | Strekowski | B65D 77/0433 |
| 11,344,090 | B2 * | 5/2022 | Hamze | A45D 42/00 |
| 2003/0127352 | A1 | 7/2003 | Buschkiel et al. | |
| 2006/0130384 | A1 | 6/2006 | Yosida | |
| 2007/0045341 | A1 | 3/2007 | Bauer | |
| 2008/0027404 | A1 | 1/2008 | Hernandez et al. | |
| 2008/0035663 | A1 | 2/2008 | Byl et al. | |
| 2008/0277408 | A1 | 11/2008 | Rapala | |
| 2009/0157033 | A1 | 6/2009 | Toro et al. | |
| 2010/0122709 | A1 | 5/2010 | Janatpour et al. | |
| 2011/0308992 | A1 | 12/2011 | Bahcall | |
| 2012/0061431 | A1 | 3/2012 | Raines | |
| 2013/0292431 | A1 | 11/2013 | Christian | |
| 2016/0090228 | A1 | 3/2016 | Soria | |

FOREIGN PATENT DOCUMENTS

| | | |
|---|---|---|
| EP | 2046256 | 4/2009 |
| KR | 200348725 | 4/2004 |
| WO | 03022094 | 3/2003 |

OTHER PUBLICATIONS

International Preliminary Report on Patentability dated Mar. 27, 2018; PCT/US16/50939.
Supplementary Search Report dated Apr. 9, 2019; Application No. 16849341.9; 8 pages.
Canadian Office Action dated Jul. 20, 2021; Application No. 2,998,542; 5 pages.
EPO Communication dated Apr. 22, 2021; Application No. EP16849341.9.; 6 pages.

* cited by examiner

SYSTEMS FOR RETAINING ABSORBENT ARTICLES AND COLLECTION KITS

CROSS REFERENCES TO RELATED APPLICATIONS

This application is a continuation-in-part (CIP) application and claims priority from U.S. nonprovisional application Ser. No. 15/905,200 filed on Feb. 26, 2018, which is a continuation-in-part (CIP) application and claims priority from U.S. nonprovisional application Ser. No. 14/864,438 filed on Sep. 24, 2015, which claims priority on U.S. provisional application Ser. No. 62/055,707 filed on Sep. 26, 2014.

FIELD

The present subject matter relates to systems for retaining a collection of articles and particularly one or more absorbent articles such as tissues. The subject matter also relates to a collection kit of personal and/or environmental products that can be used in conjunction with a material for personal use, wiping, and/or drying.

BACKGROUND

Tissues and various absorbent articles are typically provided in boxes or containers which house a relatively large number of tissues or articles and enable such to be individually dispensed. Although satisfactory for many environments or applications, such boxes or containers are relatively large and/or cumbersome thereby detracting from their portability.

Individually packaged tissues are known, however, such small packages are easily lost. Furthermore, during and/or after use of the tissue, the package is typically torn or separated into multiple pieces thereby creating inconvenience for a user in collecting the package pieces, the used tissue, and locating a waste basket or other disposal repository. This can be particularly problematic for users at outdoor events or during athletic events.

Personal, hygienic or environmental substances or products are generally used separately and are often retrieved from a purse or bag. Typically, there are no drying or wiping materials near to complete a personal care process. It would be desirable to provide a system or collection that allows a user to discreetly carry these items collectively on a person, for example in a pocket or bag. This would promote and ideally eliminate steps of retrieval and replacement of items. Ideally, the items would be retained in one area or collection and then could be used by a one hand process, for example using a tissue and then discarding the used tissue back within a retrieval area. Additionally, it would be desirable to sanitize a user's hand and then dry the hand within a covering that can be placed in a pocket or bag.

Accordingly, a need exists for systems and methods that promote ease in carrying and using tissues and other absorbent articles and properly disposing of such after their use, without polluting or losing the used tissue and/or its packaging. A need also exists for a collection kit and particularly configured and including certain components as described herein.

SUMMARY

The difficulties and drawbacks associated with previous approaches are addressed in the present subject matter as follows.

In one aspect, the present subject matter provides a personal care collection kit comprising an enclosure defining a first endwall and a second endwall, and a plurality of sidewalls extending between the first and second endwalls. The first and second endwalls and the plurality of sidewalls define an interior of the enclosure. The second endwall defines an opening providing access to the interior of the enclosure. The collection kit also comprises at least one region of an adhering element disposed along the first endwall and accessible from the interior of the enclosure. The collection kit also comprises at least one absorbent article disposed in the interior of the enclosure. The absorbent article is releasably attached to the adhering element. The collection kit also comprises at least one sanitizer container disposed in the interior of the enclosure. The sanitizer container is releasably attached to the adhering element. The collection kit also comprises at least one personal product disposed in the interior of the enclosure. The personal product is releasably attached to the adhering element. The collection kit also comprises a barrier wall disposed in the interior of the enclosure. The barrier wall extends between and prevents passage of liquid between each of (i) the at least one absorbent article, (ii) the sanitizer container, and (iii) the at least one personal product.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
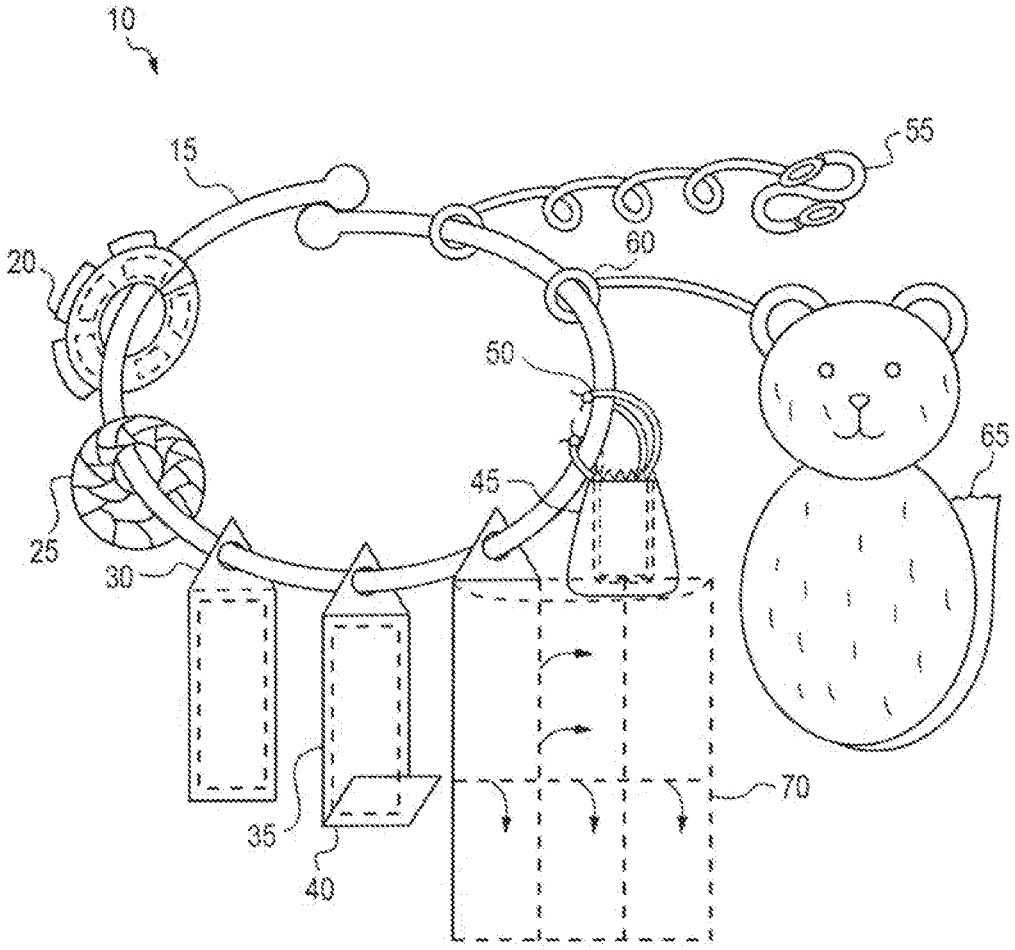
FIG. 1 is a perspective view of a retaining system including a coupling component with multiple articles attached thereto.

Generally, the present subject matter relates to retaining systems that comprise one or more articles, typically individually packaged articles, that are releasably attached to a coupling component. The articles typically include one or more absorbent articles and one or more accessory articles.

The retaining systems can optionally include one or more receptacles for receiving and storing the article(s) after use, one or more compartment case(s), one or more secondary coupling components, one or more decorative items, and combinations thereof. The present subject matter also relates to refill packages that can be supplied with a collection of articles for use with the retaining systems. And, the present subject matter additionally relates to article dispensers such as in the form of a heated stand and/or in a tapered end roll form. Each of these various aspects are described in greater detail herein.

In one aspect, the present subject matter provides a system for retaining a collection of articles. The system comprises a coupling component. The system also comprises one or both of (i) an accessory article attached to the coupling component, and (ii) a receptacle attached to the coupling component. The system also comprises one or more packaged absorbent articles releasably attached to the coupling component. Each of the absorbent articles are enclosed within a package.

In another aspect, the present subject matter provides a system for retaining a collection of articles. The system comprises a coupling component. The system also comprises a flexible wall receptacle in a folded or compressed state. The receptacle is releasably attached to the coupling component. The system also comprises a packaged tissue individually enclosed and sealed within a package. The packaged tissue is releasably attached to the coupling component.

In one embodiment, the present subject matter provides an absorbent article such as a tissue, wipe, towel, cloth, napkin, woven material, non-woven or similar material; and may include one or more additional articles for extra absorbency or to address a dual/multi need. Combinations of these may be used. It will be understood that although the present subject matter is generally directed to absorbent articles and retaining systems for such, the present subject matter also includes non-absorbent articles and their retainment. Additional details of these aspects are provided herein.

In one embodiment, the present subject matter provides a flexible or rigid package in nearly any shape surrounding and/or generally enclosing the article. In many embodiments, the package serves to protect the article(s) enclosed therein. For example, in a particular embodiment, the package encloses an absorbent article disposed within the package, thereby protecting the absorbent article from unintended exposure to water or other liquids. The package can be configured to include a frangible seal with optional features such as being waterproof, moisture proof, having heating or cooling capabilities to heat or cool the package and/or its interior contents which in turn transfers heat or cooling to the package contents. The packages can also include one or more reflective media strips, glow in the dark media, lights, power source(s), ink, and/or design embellishments. The package may include a temperature sensor for remote or wireless control of the package and electronic(s) to adjust the timing and/or temperature such as by use of a thermostat. The package can also include one or more solar cells to convert light into an electrical power source for use in heating, cooling, or powering electronics incorporated or associated with the package. The package can include one or more of inks, print media, adhesive labels, and/or other media to include text, information, symbols, trademarks, and/or company name(s) on the package.

The present subject matter provides a coupling component that serves to retain the articles together as one unit. The coupling component can be any flexible or rigid material such as an adhesive member, band, clip, clasp, hook, latch, fabric, snap, string, wire or similar material. Combinations of these can be utilized for the coupling component.

All or a portion of the articles in packaged form or unpackaged form, can be housed or retained in a compartment case or holding device. The compartment case can be formed from a hard and/or rigid material, be waterproof, include one or more wicking materials or other flexible type material. The case generally defines an interior compartment sized and/or shaped to receive and hold various items such as for example, one or more absorbent articles. The compartment case can be of varying shape or size. The compartment case may have an attachment feature such as the previously described coupling components that can attach to or be positioned around any portion of a user's body, clothing, or any substrate. In certain embodiments, the compartment case is attachable to the coupling component of the retaining system. However, generally the compartment case is provided and used separately from the retaining systems. The compartment case can be in the form of a recording device, playback sounding device, or speaker for example. The compartment case can be specifically configured to hold one or more key(s), credit type card(s), and the like.

The absorbent or non-absorbent article(s) can include any combination of features including a scent, scent pack, powder, can be of varying size and/or shape, can include any number of plies, layers, layers of any feature therein, can exhibit a wide range of texture, thickness, absorbency, can include liquid, lotion, dye, color, embossing, printing, moisture, medication, anti-allergen agents, antiviral material, be glow in the dark, can include feathers, hypoallergenic material, down material, fabric, stitching, quilting, softness, a cool touch feature, a warming touch feature, heating or cooling feature, batting or any similar fluffy material, glue to hold any part of the material and its features together that conforms to approved safety laws, and combinations thereof. In certain embodiments, the article(s) may also include one or more decorative items such as pressed flowers, leaves, herbs, stems, moss, potpourri, butterfly wings, bark, spices, natural element(s), shaving or particles of any of the previously mentioned items or similar items. These items can be made to look real or be in their natural form. The article(s) may or may not be flushable or readily disposable. These features add to the beauty, scent, comfort and purpose of the product.

Coordinated single, dual or multi-use lotion(s), antibacterial agent(s), powder, medication, wax, extract, sunscreen, insect repellent, perfume, makeup, anti-odor agent(s), solid(s), oil, liquid or gel based product(s), natural element(s) or commercial element(s) may be included in the article(s). The articles may be packaged in single or multi-use packs or combined therein. An optional resealing feature is available to close a package if contents, e.g., articles therein, are not all used. These features may be incorporated in the packaged absorbent or nonabsorbent article and/or scent pack. Any combination of these materials may or may not be used.

Packaging also can include any combination of articles and coordinated features.

An adhesive or other joining material may be used to attach a packaged article and particularly a flexible packaged article to other materials such as metal, fabric, nylon, plastic or similar substrate(s) for use at a later time. This may be useful after detachment of a packaged absorbent article from a coupling component.

The present subject matter also provides one or more receptacles that can be included in the retaining systems.

The receptacle(s) is typically attached to the coupling component. The receptacles receive and conveniently store used articles such as used tissue(s) until an appropriate waste receptacle is located. The receptacle can be in the form of a pouch, bag or other compartment to keep used absorbent articles or used packaging with the system. In many embodiments, the receptacle is in the form of a flexible wall container that defines an interior hollow region. In particular embodiments, the receptacle is in the form of a flexible wall receptacle in a folded or compressed state. The receptacle is releasably attached to the coupling component. As will be appreciated, during and/or after use of the receptacle, the interior region of the receptacle can house used absorbent article(s) and/or other items. The receptacle can also include a sealing provision for selectively governing access to the interior of the receptacle. This enables the receptacle and its contents, if any, to be sealed or otherwise separated from the environment.

Any number of individual or combined articles can be provided with any combination of coordinating features to form a retaining system in accordance with the present subject matter. The term "coordinating features" as used herein refers to matching or complimentary colors, designs, and/or aesthetic elements that are provided to promote appearance or attractiveness of the system or collection of items.

The coupling component allows for choices in determining the means of carrying or storing the collection of articles. The size, shape, and material(s) selected for the coupling component can vary to accommodate the needs of the user. The coupling component can include or be in the form of a retractable clasp, loop, magnetic ring, keychain, lanyard, purse holder, clip, hook, pin, clasp, snap, or other similar joining mechanism. The coupling component can be made from metal, plastic, fabric, or similar materials or combinations thereof. In many embodiments, one or more articles can be easily removed or detached from the coupling component.

In certain embodiments, the retaining system can be separated into individual unit(s) and/or include secondary coupling component(s) that may attach to other substrates which in turn allows the articles to be easily concealed if desired. Examples of system concealment include, but are not limited to the following. The retaining system or portions thereof can be carried in a pocket, small purse, wallet, or bag. The retaining system can be attached by use of the secondary coupling component under a desk, dashboard, shirt sleeve or other clothing material, for example, clothing of a runner, outdoorsman, or active person. The retaining system can be attached to a bike for those who are out on long rides and not near any restroom facilities. The system can be easily accessed if placed on handle bars of a bike. The retaining system can also be attached under a spa/hair salon cape. If for example, a user is receiving hair, nail, or spa service, the user would otherwise have to ask someone to provide the user with a tissue or interrupt an attendant so that the user can obtain the tissue or other article.

The retaining systems may also include one or more decorative components and/or be used as an art form in which individual elements, e.g., articles, can be placed on a picture frame or other substrate that serves a dual purpose. One purpose is to house the articles in a form that is not currently practiced thereby allowing an individual to selectively remove one or more articles at a future time as needed. The second purpose is the original function of the picture frame, i.e., to support and enclose artwork. It will be appreciated that the present subject matter can be incorporated into a wide array of otherwise utilitarian objects. Another prime application of the present subject matter is in advertising or promotions. For example, the retaining system can be placed in, or otherwise provided with, a card, folder, invitation, program, or other literature. Company logos can be included in the system and/or the articles and/or coupling component as a marketing tool.

Although absorbent articles packaged for carrying in a user's pants or shorts pockets are known, in many instances such "pocket packets" are too large. These currently known packets are typically bulky with dimensions that are larger than necessary and are noticeable.

The present subject matter provides convenience resulting from carrying a lighter weight and/or smaller size of articles. This is especially important for active individuals or those that are already carrying many items. Currently known cardboard type packaging, rigid plastic packs and flexible multi packs for tissues and/or other absorbent articles do not allow for the option of less weight. If a single tissue is carried, the tissue is typically exposed to the elements or the environment and thus not protected nor hygienic. The article(s) of the present subject matter can be configured so that the articles and/or system can fit into a user's pocket(s) or be used in other carrying modes. Each of the packaged articles can be moisture proof, waterproof, wrapped or unwrapped.

The retaining system can be selectively sized as desired. The entire system may be carried and/or individual articles can be selectively released and used therefrom. Currently known collections of articles such as rolls and larger units on the market utilize hard plastic containers, are heavy, and/or use cumbersome receptacles or none at all.

The present subject matter may also provide refill packs for individual articles or collections of articles. The refill packs and/or individual articles can easily be dispensed and/or separated and placed individually in a mailed greeting card for example. The articles can be attached as a collection of multiple articles or individually to any invitation, any ceremony program such as a wedding, communion, and graduation, professional or social event. For these applications, the articles are placed in a dispenser/package that is relatively quiet and "low noise" when used. Typically, at such occasions a tissue or other absorbent article is desired. Currently these articles are not placed in a convenient location such that distractions result at the event as a result of individuals attempting to locate the articles. Currently known articles are also typically placed in packaging that can be loud when dispensed. In addition, waste receptacles must then be found to receive the used article(s) or else unsanitary practices result from haphazard discarding of the used article(s).

The present subject matter allows for any number of tissues to a bag or other receptacle for holding articles. The receptacle may include a sealing provision to prevent other unused articles from absorbing moisture from used articles. Currently, items such as boxes of tissues and/or pocket packets can become wet from exposure to a single used article.

The retaining system can be provided in a variety of forms for carrying a collection of articles in a fashionable, convenient way, and/or to separate the articles from one another as needed. At present, there is no retaining system for carrying a collection of articles with as many choices.

Compartment cases for carrying the articles allow a user to tailor how many absorbent articles are carried together without the articles becoming loose after dispensing.

A current trend is for designers to have multiple product lines such as clothing, purses, hair accessories, jewelry, etc.

Compartment cases and/or articles can be personalized to manufacturers or designer collection tastes. Personalized designs can be provided in association with one or more of the article(s), package(s) for the articles, coupling component(s), and/or other components of the retaining systems. Additional components such as jewelry beads according to the designer or product line can be purchased or later provided. At present there are no designer carrying tissue cases on the market. Instead, only utilitarian style cases are available.

The articles and/or their packaging of the present subject matter offer a variety of coordinating features. Currently known articles are very limited in color and design with no custom or personal features.

The retaining systems can include tissues and makeup for a more convenient travel size system. Individual makeup compartments and/or packages can be included such as foundation, concealer, lipstick, eye shadow, makeup applicators and personal care items such as q-tips, cotton balls, emery boards, mouthwash and breath strips, tooth paste, etc. These are representative examples of various accessory articles that can be included in the retaining systems. Coordinated individual features can be provided. Currently available makeup and/or associated products are available only in large quantity sizes. Typically, such makeup and/or makeup products do not come in individual or smaller multi packets for convenience. Therefore, many users carry their entire cosmetic drawer with them when they leave home. The present subject matter would give users many more choices in makeup selections and a convenient and uniform way to carry makeup products.

Refill packs offer variety in size, quantity and coordinating features. Currently, there are very few options available on the market.

A compartment case option allows an interior of a case compartment to be filled with one or multiple individually packaged or multi-packed tissue(s) or other articles. The case allows for an option for tissues without packaging since the case can be waterproof, moisture proof or simply covered. A case can easily be refilled from a refill package because the articles do not have to be dispensed one article at a time such as in the refilling of a tissue box upright container.

Individually packaged articles can be sized and shaped to fit within such compartments. Typically, pocket packet tissue sizes do not fit into short or long banded compartments easily because they are usually provided in one cumbersome size with multiple articles.

A collection of articles such as tissues can include as a coordinated feature a trash receptacle which appeals to children or adults' personal tastes. Thus one or more tissues can be matched with a receptacle, all of which are included in a retaining system. Currently there are no "fun" or personalized mobile trash receptacles attached to or provided with tissues. Typically, trash receptacles are separate units that are loose, separate, and remote from areas at which tissues are typically used.

The coupling component can include a clasp or other resealing element to close a package containing a material or agent such as running gel or other liquid that is not fully dispensed from its package so as to not spill. Currently runners carry pins and binder clips as a solution but these items are loose and frequently become separated from the package or otherwise lost. There are no products on the market that can house such articles such as gel/liquid packets that can be securely closed in a manner as to not spill out on other items, and then conveniently attached or included in a retaining system. These gels can be very sticky and uncomfortable on hands, body or other surfaces that may be contacted.

The coupling component can be sized and shaped to fit around a wrist, an ankle, smaller part of the body, waist, larger part of the body, or other substrate such as a water bottle. Flexible or non-flexible materials can be used which may optionally include a clip or enclosure that can hold a packet of liquid that has been opened and reseal the packet until the packet is completely used and ready to be discarded. The coupling component can also be used to hold an item in place securely to the user or wearer of the coupling component. As noted, in many embodiments the coupling component is in the form of a band.

Figure 4:
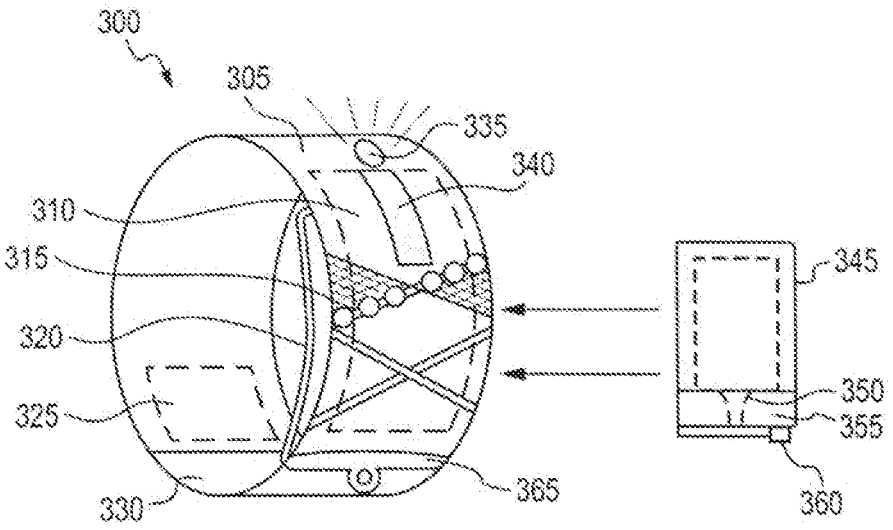
FIG. 4 is a perspective view of another retaining system utilizing a flexible band as the coupling component.

Examples of various bands include jewelry, a purse, having adhering properties, worn on the wrist or ankle as shown in FIG. 4, worn on the head as in a hat or headband, worn on or around the neck, width dimension expanded to cover leg and arm sizes, the band becomes the coupling component itself, a coupling feature that can then attach to other substrates, magnetic feature, multiple dispensing feature, and as attached or used as an integral part of clothing.

The band could be designed as a piece of jewelry whereas the wrapped article is hidden or concealed within the band. For example, in a pocket where there is a backing to the jewelry and the package is not contacting the skin directly should it be worn on the wrist. The band can be wrapped around an arm or substrate with one end sliding though a hole at the other end of the band thus forming another style of fabric bracelet aesthetically pleasing to the user. This again becomes the jewelry/art form that someone may wear. It may be a very small form as in a ring. A coupling component can be added to form a necklace. The user would have much comfort in knowing they have an absorbent article on hand.

The band can be designed to form a purse or sack where a clutch type strap is used or placed inside the band and taken out when a different carrying mode is desired. The length of the strap or coupling device can vary in size, length, material, and purpose. The band allows someone to carry a very small purse that is not easy to find on the market. It can be a more athletic/sporty style purse. Many gym bags are quite cumbersome and usually are in the form of a duffle bag or drawstring style. These carrying modes typically are not made of elastic material. This dual purpose band can be large enough to form other shapes, possibly larger ones also.

The band or any of its parts could have a silicone, polyurethane, or other similar material that adheres to the skin. The material is similarly used for women's strapless bras. The material becomes releasable from the skin and leaves no irritating skin marks or material. This band can be adhered to virtually any part of the skin.

The most basic form of the band as shown in FIG. 4 can be worn on a wrist, ankle, or hand. One can easily slide it over the hand or foot to the wrist or ankle position through the hole. Because the material is expandable/elastic, this band use can be moved with ease. One may simply hold the band in the hand with the band surrounding the palm whereas the fingers go through the hole and then is held in place with the thumb and with tightening properties the band consists of.

The band may be worn as a headband. Because it can have moisture wicking properties it can serve this purpose as well as a carrying device. This allows the user to be hands free from anything restricting the users other body parts. For example, if a user is running, it would then make the user not feel heavier or weighted on one side or the other if it were to be used on a leg or arm. This would then apply to a hat form whereas the band has a material membrane that covers the head. This membrane can still have an opening to be used as a headband. It can be a versatile product. This concept can also be applied to the neck. If the user would like nothing on their head, they can then pull the hat or headband down to the neck area. Again the user would not have anything then on their arms or legs and creates this hands free, non-cumbersome carrying device.

The width of the band may be increased significantly enough to create an arm or leg cover or compression type feature. Skin can be easily exposed or not. The other features can still be present on the band. The advantage to this type of use again is its versatility. One can then lower or raise the band on their arm or leg possibly when temperatures of the body increase or decrease. The shape width then decreases. This applies to the waist area as well. For example this feature would allow for an outdoorsman to be more comfortable in their climate as well as carry the necessities as described in the patent.

The band can become the coupling unit itself. It would have a flexible component that allows the band to be shaped and then maintain its shape. For example, it is similar to a twist tie. The features are still present. This design gives the option of the band to wrap or be used in, on, around, or combinations thereof additional substrate attachments. The band can be twisted around an article of clothing. The clothing would then not be damaged.

A most widely used item is water. Most people try to fit a water bottle in another carrying unit or it is carried separately which the user often finds cumbersome to do both. Therefore, this band serves a need whereas this band fits around a water bottle. Another carrying device larger than a water container is then not needed. The band fits around a water bottle or container which allows items to be centrally located and convenient. A simple strap/coupling device on the band can be utilized for carrying ease. Runners or outdoorsman typically carry a unit that serves this most basic need. Most carrying devices do not offer the flexibility and versatility of this band unit. Most people try to fit a water bottle in another carrying unit that just serves this one need. Therefore, this band serves multiple needs. A water treatment pill certainly can be carried in this band for use in an emergency situation where sanitized water is needed. Another substrate example that the band can easily fit around is another strap, for example, a backpack, waistband, belt loop, purse strap and the like.

A magnetic feature may be added as an integral part of the band. This allows the user to attach the unit to any metal or magnetically attracting substrate. The closing ends of the bands can serve a dual purpose. One is being the closing mechanism and two when they are separated the one end can attach to other substrates.

The band can be of a decorative form where multiple dispensing features are present. For example, it can fit around or attach to a stand, toilet paper roll, vase, other accessory or substrate, Multiple openings can allow articles to be pulled out from more than one opening at a time. Individual articles are held in place with a coupling component from the bottom of the individual packages. The packaging can be similar to FIG. 2 where the article is concealed, the top portion shown and then item 105 accessed to be used efficiently. The bottom portion of the packaging can then remain in the band or substrate.

The band closure can be opened. The band is now a linear item and can be hidden in a clothing item or other substrate with more flexibility in shape. A coupling component can be added to the band and then attach in any number of means.

The article package, absorbent or nonabsorbent material of the article, and/or the coupling component can have a reflective and/or glow in the dark media safety feature. This is believed to be especially useful for outdoorsmen. As far as is known, there are no glow in the dark absorbent or nonabsorbent articles such as tissues on the market.

The retaining system can be provided in a waterproof container or package. If the packaged retaining system is in a wet environment, the tissue or other article(s) is still dry when needed.

The packaging used for one or more of the article(s) and/or for the retaining system can be of any currently known packaging material such as a variety of polymeric films such as polyethylene and/or polypropylene, polylactic acid (PLA), composite materials such as plastic coated papers, and combinations of these materials with others. In many embodiments, the packaging material is selected to exhibit low noise upon deformation or opening of the package.

The packaging can utilize any known opening style. The packaging can include a frangible seal, zipper style seal, perforated seal, break away seal, or in the case of fabric using other materials to close the package, keep it closed and have reopening features or the like. The packaging can be of any shape, size, grade, quality and any combination thereof. The article(s) can have coordinating features that can include or have no package so that the article(s) can fit into any previous or future mentioned compartments or packages. The article(s) can be moisture proof, waterproof, wrapped or unwrapped. The packaging can be flexible plastic, corn based plastic, fabric, webbing, netting, flexible metal wrapping, rigid material or other similar products to hold the article. The package can have any number of embellishments to enhance design or use. The package/bag/pouch as in item 35, 65, 70, 100, 200, or 300 may have an additional slot/opening/pocket to house any other personal item such as money/key, etc., or serve as a receptacle. Any of these may have resealable/closing features for item containment purposes.

The absorbent or non-absorbent material of the article can have multiple coordinated feature(s) or option(s) for companies and to utilize as marketing tool(s), gift(s), or for nearly any application or purpose.

Children can dispose used articles in a kid friendly pouch or bag that can be placed in a proper receptacle at a later time. A coordinated separately wrapped feature such as lotion, antibacterial, powder, etc. can easily be attached to a coupling component in which all elements or features can be carried together without having to search for a separate unit in a purse, bag, glove compartment, makeup bag or the like. This allows efficiency and cleanliness since an optional antibacterial product can also be included in the retaining system. Currently there are no products on the market that offer the convenience of using a tissue or multiple tissues and disposing of these items using an incorporated receptacle. Used tissues are widely one of the most used items that should be placed in a trash receptacle immediately afterwards for sanitary reasons. Also hygienic lotion or gel is typically not provided with or attached to articles such as tissues and such lotions or gels are usually provided in the form of a separate article that must be opened, touched, and then dispensed. All of these factors reduce hygiene. Incorporating a portable receptacle in the retaining system empowers children to take care of necessary hygiene on their own without leaving behind loose used articles and tissue containers. All the items needed can be provided in one unit and at a single location. Caretakers then do not need to be responsible and dispose used articles or find receptacles.

In certain embodiments, the attachment of the articles on the coupling component can be in the form of a packaging tab. A hole or aperture at the top of the package, in combination with ribbon, jute, twine, string extending therethrough; the article wrapped around the coupling component; a magnet on one or both ends of the article to attach to a metal ring or two magnets that hold the articles on and joined by another coupling component; or other attachment provisions can be utilized. Any similar or like material or combination of materials may be used to attach the article to the coupling component.

A scent pack can be included with the refill packs, individual article packages or provided separately for a consumer to use at their chosen location. The purpose of the scent pack is to maintain and lengthen the time during which the scent is detected/smelled. The scent pack can be in the form of any material that imparts or exhibits a scent or smelling feature. These scents in turn can influence mood, work performance, health when used for medicinal purposes, behaviors and emotional associations. Another feature may or may not include a moisture retaining material such as rice, starch, silica gel or similar moisture retaining material to keep the article and/or any other said parts from moisture. Article packages can be configured to include separate compartments or interior regions to house the scent pack(s) and/or moisture retaining material(s). The package compartments can be formed from interior partitions or walls that separate or at least partially separate the article within the package from the scent pack and/or moisture retaining material.

FIG. 1 is a perspective view of an embodiment of a retaining system 10 comprising a coupling component 15 and a plurality of articles releasably attached or affixed thereto. The articles include one or more absorbent articles, one or more receptacles, and one or more accessory articles. Each of the articles and/or receptacles can be attached to the coupling component in the same manner or in different ways. In many embodiments, the accessory article(s) can be in the form of a case defining an interior compartment, a secondary coupling component, a decorative item, makeup or makeup items, and combinations thereof. These and additional aspects of the retaining system are further described as follows.

As noted, item 15 is a coupling component. In this embodiment, the coupling component is in the form of a metal ring that can be selectively opened or separated. Other materials such as plastic, rubber, rubber coated metal and the like can be used for the coupling component.

Item 20 is an individually wrapped article that is positioned to extend around the coupling component 15. In this embodiment, the article is a tissue and its package is coiled into a circular form and attached at each end around the coupling component on both ends to form a closed member. The ends of the tissue and/or its package are held together by an adhesive or other component or material. In this embodiment the article is folded then placed in a package. FIG. 1 illustrates the article in a "pill type, pop out" form in which upon pressure application to an end of the package the article is then released from a flat releasable/breakaway film that is located at its opposite end. The articles may or may not be shrink-wrapped, twisted, crumpled, deformed, folded or designed in a shape prior to placement in a package. Article 20 can be removed from the coupling component and be worn around a wrist or neck as a necklace or attached to another substrate. Article 20 can be embellished or made to resemble jewelry so as to have a dual purpose. Article 20 can also be placed on the coupling component by the user and the quantity carried can be determined by the user. The article 20 may also be wrapped multiple times around the coupling component with or without joining both ends. A single end can be attached to the coupling component to retain the article 20. In certain versions, the packaged article 20 is configured to be the smallest size possible, but useful and large enough when opened, e.g., similar to a typical tissue or toilet paper size.

Item 25 is an example of a package and article both of which are twisted, crumpled, folded or designed into a shape along with a coupling component on both ends similar to the previously noted pill type form package. The package and its articles together can be twisted along with the article or just the article can be twisted, crumpled, folded, designed in a shape and then placed in a package.

Figure 2:
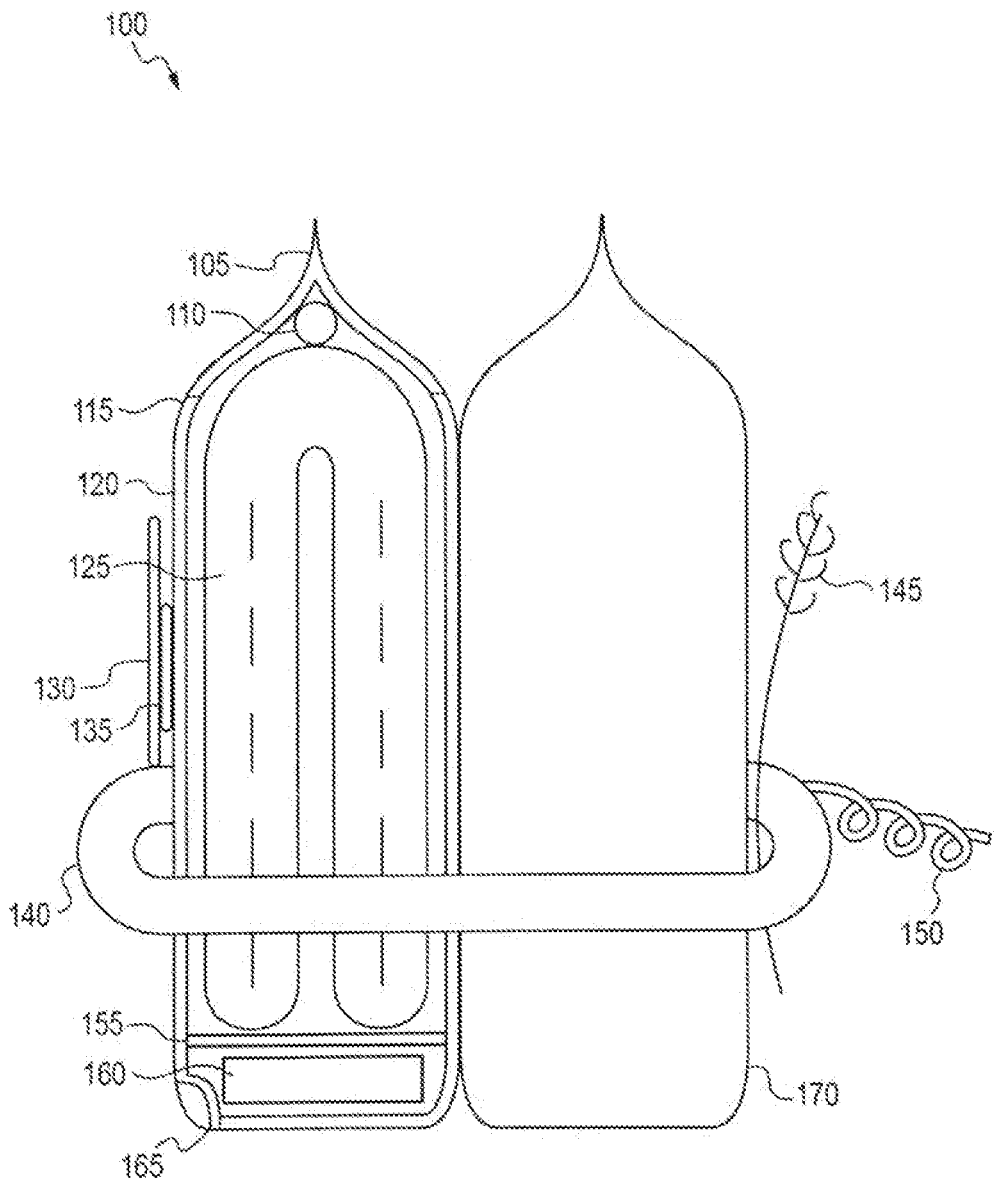
FIG. 2 is a schematic cross section of an individually packaged article with its package and an adhesive feature, a breakaway seal and a scent pack.

Item 30 is an example of an article including a package attachment hanging tab. The tab can include a perforated edge for easier article separation. The top attachment stays on the coupling component 15 while the user can pull away and separate one or more articles and/or their package and its contents quickly. This allows for easier separation from the coupling component while leaving the tab attached. Any number of break-away features can be used. One example is depicted in FIG. 2 described below. The user would then reach in with their fingers to grab the article out of the package once the package breaks away and is open.

Item 35 is an individually wrapped absorbent or nonabsorbent article that is placed in a package. The article can include any single or combination of coordinated features.

Item 40 is a frangible seal with a possible separate compartment for coordinated features. A lift flap opening can be provided at the bottom of the package which allows for dispensing of a tissue and then leaves the package still attached for waste containment purposes. The article when used can then be placed back in this package and the package used as a receptacle. After use, the article and package can then be thrown out at a permanent trash receptacle at a later time. Another example of a housed coordinated feature is a coin slot. The seal of the package can be opened, money/card, etc., removed, then remaining items reinserted back into the package and finally package can be resealed.

Item 45 is an example of an article or article housed in a fabric package, pouch or bag. The packaged article can be removed from the coupling component while the article remains packaged. Any shape of article such as tissue is acceptable. The article can be flat, two dimensional or planar, or of a three dimensional style. Any shape, size or style of tissue and packaging can be used. The fabric package, pouch, or bag can house articles exclusively or the articles can be further wrapped in plastic, such as in FIG. 2 so to serve multiple functions. The article can have any number of coordinated features as well.

Item 50 is a fabric member or woven cord or ribbon that is attached to the coupling component. The ribbon in this example serves to hold the articles in the bag 45 as well as provide attachment to the coupling component.

Item 55 is a retractable or non-retractable attaching provision or secondary coupling component that can releasably attach to an interior car grab bar, handle, diaper bag, gym bag, briefcase, purse, or other similar carrying device or to a place of interest. This enables the retaining system 10 to be secured to a desired location.

Item 60 is a ring, hook, latch or similar device that can be easily removed from the coupling component 15. One or more other items or articles can be affixed to item 60.

Item 65 is an example of a receptacle for waste or trash. In this embodiment, the receptacle 65 is in the shape of an animal for children or adults to use. Any shape or size or material can form this trash receptacle 65. The trash receptacle 65 includes a generally open or hollow interior region that can be accessed via one or more openings defined in the receptacle 65. Typically, the receptacle is in the form of a flexible wall bag formed from one or more polymeric films. The receptacle 65 may or may not be lined for hygienic reasons in a film or flexible pouch that is removable or non-removable from the coupling component 15.

Item 70 is an example of another receptacle in the form of a plastic bag, initially folded, and then opened to receive a used article for disposal. The bag can easily be removed or separated from the coupling component 15 to then be disposed of in a trash receptacle. The bag is initially folded or designed in any number of shapes/combinations for children and others to promote an improved "throwing away" experience. An absorbent or nonabsorbent article can also be stored initially in this receptacle.

FIG. 2 is a schematic cross section of an individually packaged absorbent or nonabsorbent article 100 disposed within its package and adhesive feature, breakaway seal and scent pack. Multiple articles can be joined or packaged together.

Item 105 is a pull top tab. In this embodiment, the tab 105 is located at the top of the outer package where a user's fingers are placed and pressure is applied to commence a breakaway feature that is located at 115. The user may or may not squeeze the tissue and attachment material described in 110 along with this tab. The purpose of this tab 105 is to provide quick dispensing of the article or tissue as in the case of a sneeze and for those that have difficulty in using a lift flap window product currently known in the market. There is then no need to lift a flap and then reach in and locate the article. There are then two less operations involved in using a tissue from a conventional pocket pack. There is a possible savings of a third operation otherwise associated with having to close the flap.

In certain versions of the systems and products described herein, an absorbent article may include multiple articles initially joined or affixed together, but which can be easily separated as desired by a user. This enables a user to dispense multiple articles from a package and/or a system. After dispensing a desired number or amount of absorbent article(s) from a package or system, a user can use the collection of articles, or separate one or more from a remaining portion as desired. As previously described, absorbent articles can be joined or affixed to one another using a variety of techniques such as by folding, tacking, and/or adhering with each other. It is also contemplated that multiple absorbent articles may be provided as multiple layers or sheets relative to one another.

One or more absorbent articles may be formed into a wide array of shapes such as but not limited to round or spheroidal, "puff ball," or flower shaped. Use of particular shapes will promote use of the absorbent articles and increase frequency of use thereby reducing potential or spread of pathogens or contaminants. The use of the absorbent articles in this manner will be beneficial for health care professionals and related facilities. Use of the absorbent articles in such manner can also increase surface area of an article and thereby further promote an article's capacity to clean and/or promote sanitary conditions. The present subject matter also includes increasing the number of layers, increasing absorbency, and/or increasing comfort provided by the absorbent article(s).

Item 110 is an attachment provision for the article such as one or more packaged tissue(s). This can be any number of attachment capabilities such as glue, string and tie, plastic attachment or similar materials to adhere the tissue so that when the packaging is released from its breakaway point and when it is pulled upon; the tissue is released from the package in full. The tissue can then be opened up from its compartmentalized or folded state and be used. In this example, the attachment provision 110 is similar to a "flower petal" incorporated in the package. The center of the flower shape provision 110 once pulled out is at the top break away point and then as a user pulls it out of the package, the provision 110 opens up into a flower shaped article. The attachment provision 110 can have multiple plies or layers of sizes to form its shape. The attachment provision 110 can be held together by a stitch, adhesive or previously described components.

Item 115 is a perforated seal area that can break away from the main package. Any number of breakaway style packaging may be used.

Item 120 is an outer packaging material. The packaging material can be of any polymer combination, PLA based, or biodegradable material. The packaging material can vary in thickness, grade, material, color, ink, print or combination thereof.

Item 125 is an absorbent or non-absorbent article, which can for example be a tissue. The article may have any or all or combination of features described herein.

Item 130 is a pull tab or release liner that is removed by applying pressure from the fingers to easily release the pull tab 130 from the adhesive of item 135. This tab 130 is then discarded. The tab can be provided along the exterior 120 of the package 100 with a removable adhesive and in the form of a finger tab pull. The tab 130 protects the adhesive from contamination and is removed prior to contacting the adhesive to a substrate of interest.

Item 135 is an adhesive or adhering material for attaching the package 100 to an interior car grab bar or handle, diaper bag, gym bag, briefcase, purse, or other similar carrying device or surface of interest. The adhesive may also be used for a business promotion with a company logo printed on the package or embossed and/or printed on the article itself. Similarly the adhesive 135 can be used to adhere the package 100 to an invitation, card, etc. The adhesive is of commercial or multipurpose quality whereas it does not stain or permanently stick to any other substrate. The formula, size or shape may vary based on its intended use. The adhesive can be released from its substrate easily with a user's fingers or other object. The adhesive can be released from the package if desired. The layer of adhesive may have different adhesive qualities on either of its sides/surfaces. In certain embodiments, the adhesive is in the form of contact adhesive used for credit cards and coupon cards that are mailed and attached to paper. The adhering material may be of a Velcro style or other similar commercial material. This method of adherence would then allow another substrate to maintain one portion of attachment surfaces for multiple uses. An example would be for an underside of a desk in which one Velcro component could be permanently affixed to the desk.

An example of another joining device would be a component having adhesive/adhering properties. The individual articles can be stacked one on another. An adhesive such as the one shown in FIG. 2 item 135 can be used. Item 130 would not be present, so another individually packaged article can be placed adhering to the initial article. Thus, one substrate is attached to where the item is used from and additional articles are stacked and taken off one at a time. For example, this might be the case as in a car's dashboard. An article(s) can be reached in front of the driver with no distraction in looking for an article in an obscured place. The packaging can be removed exposing the next article or item 105 which can be utilized as a safer means of dispersement and use of the article.

Item 140 is a flexible band of stretchable or elastic type material, clip or similar joining device that holds or grips the packaged article 100. The band can be simple or embellished with beads, color, or any assortment of paper, plastic or similar material in the shape of flowers, hearts, or any other to suit personal tastes or business needs.

Item 145 is an example of an embellishment or decorative item. It will be understood that FIG. 2 merely represents one contemplated form. Embellishment examples can include any crafting type material, charm, sticker, trinket, fabric, lace, jewelry, stamp, shape, size, color or any other material to provide a desired concept or theme to a targeted end user.

Item 150 is a retractable or non-retractable attaching provision that can be a feature to attach to an interior car grab bar or handle, diaper bag, gym bag, briefcase, purse, or other similar carrying device or to a place of need.

Item 155 is a separator or partition to segregate the scent source from the remainder of the package 100. The separator 155 may also be a permanent separator with lotion, etc. or any other listed features.

Item 160 is a scent/dual purpose pack. A scent or fragrance pack can be used to increase or prolong the time period during which fragrance is provided. The scent pack 160 may or may not include another tissue, wipe, fabric, other scented material such as a flower, materials that are made, natural materials, oils, incense, gel, liquid, bead, etc. Any combination of scents can be included. The scent pack 160 may be a mesh type bag or partition that allows the scent to permeate into the tissue 125. The pack 160 may be placed in any location of the package 100.

Item 165 is a tear feature to release contents of the package 100. The contents may include a tissue 125, a wipe, or other similar item.

Item 170 is an additional article optionally including all or some of the same features as items 105-165 to represent multiple joined articles.

Figure 3:
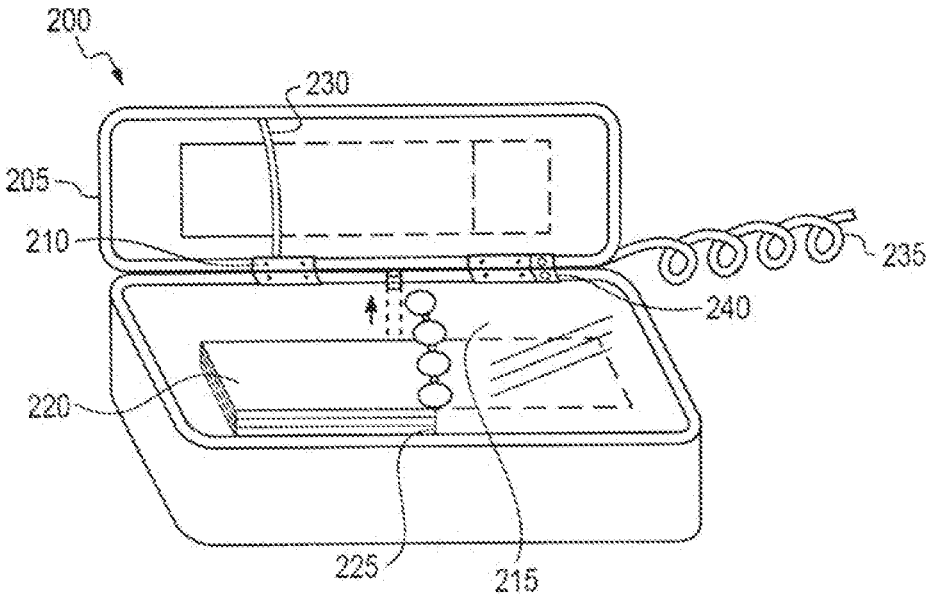
FIG. 3 is a perspective view of a compartment case that houses one or more articles.

FIG. 3 is a perspective view of a compartment case 200 that houses one or more articles and or coordinated features thereof.

Item 205 is a compartment wall, lid, or cover that can be waterproof, rigid, flexible, transparent or formed from an opaque material.

Item 210 is a hinging/flexible provision to allow access to the interior of the compartment case 200. The provision 210 can be located in any part of the unit i.e., top, bottom or back.

Item 215 is an interior of the compartment case 200. The interior 215 can be lined with fabric or other material or be the same material as the outer compartment.

Item 220 is one or more absorbent or non-absorbent article(s). The articles 220 can be individually packaged, or the collection can be packaged. The packaging is typically a flexible wall film.

Item 225 is a flexible or nonflexible joining provision typically located at the sides of the compartment case. The joining provision 225 can be embellished with beads and the like. The joining provision serves to hold the articles 220 in place when the cover of the compartment is opened so the articles 220 are retained therein. The joining provision 225 can be easily removed on one side to add embellishments, and then re-attached in place once again when finished.

The joining provision 225 can be in the form of a circular band. The circular band could then be removed in its entirety along with the articles and used as such in FIG. 2. The joining provision 225 can have a separate attachment coordinating feature. The joining provision 225 can be configured to function when one individual tissue that is or is not separately packaged is released one at a time when the user pulls at one tissue for use.

Item 230 is a slot or interior compartment to house additional articles or keys, cards or any other personal item(s) for example.

Item 235 is a retractable or non-retractable attaching provision that can include a feature to attach to an interior car grab bar or handle, diaper bag, gym bag, briefcase, purse, or other similar carrying device or to a place of need.

In certain embodiments, the compartment case can be configured as, or include, a recording/playback device. In such embodiments, item 240 is a switch or actuator for the recording/playback device. The device is activated when the compartment case 200 is opened. The device can be configured to emit words of encouragement, motivation, prayer, humor, music or safety warnings for example.

FIG. 4 is a perspective view of an embodiment of a retaining system 300 using a coupling component in the form of a flexible band. The system 300 includes a packet of exercise gel attached.

Item 305 is a band that can be of any material such as spandex, athletic wicking material, fabric or other flexible similar material. In many embodiments, the band 305 is formed from an elastic and flexible material.

Item 310 is an article releasably attached along an interior of the band 305. The article 310 can be located along an exterior of the band but under a joining provision or the article 310 can be housed along the interior of the band with the band fabric on top of, and/or under, the unit as in a pocket type application.

Item 315 is a flexible or nonflexible joining provision, typically extending between the sides of a compartment optionally provided on the band 305. The joining provision 315 can be embellished with beads and the like. The joining provision 315 serves to hold one article or several articles in place so the items do not fall out or blow away. The joining provision 315 can be easily removed on one side to add embellishments, and then re-attached in place once again when finished. The material of the joining provision can be elastic, stretchable cording or webbing type fabric to suit its purpose.

Item 320 is a pocket with an opening for the article, key, card coordinated article feature or other similar items to be placed. The pocket 320 can include a Velcro type, folded edge or banded edge to retain its contents.

Item 325 is a closure provision of the band, i.e. Velcro type or clasp type. The closure provision 325 allows for lengthening or shortening of the band 305 to fit according to tightness required.

Item 330 is an interior side of the band 305.

Item 335 is a light that may be configured to blink along with having a power source to be used as a safety feature.

Item 340 is a glow in the dark media strip or fabric as a safety feature. The entire band 305 may include this feature.

Item 345 is a self closing individual packet. In this embodiment, the packet 345 is in the form of an exercise gel packet. The packet 345 may also attach or fit under the joining provision 315 or within the pocket 320.

Item 350 is an interior release tip for dispensing contents of the packet 345. The contents are released when pressure is applied on or toward the interior tip.

Item 355 is a rigid material so that the interior tip is protected and can only be reached by a finger or other small article.

Item 360 is a closure. Closure 360 governs access to the contents of the packet 345. The closure 360 is typically configured to allow a user to easily open and/or close the packet 345. In certain embodiments, the closure 360 is in the form of an edge or end region of the packet 345.

Item 365 is an integral clip, hook, latch or other device to close and hold an article in place. Item 365 can hold one or more article(s), coordinating features, a key, card, or a sport type gel. Item 365 allows for when an opened unfinished article is not fully used the clip 365 will serve as a closing feature so that no contents of the opened package escape.

Figure 5:
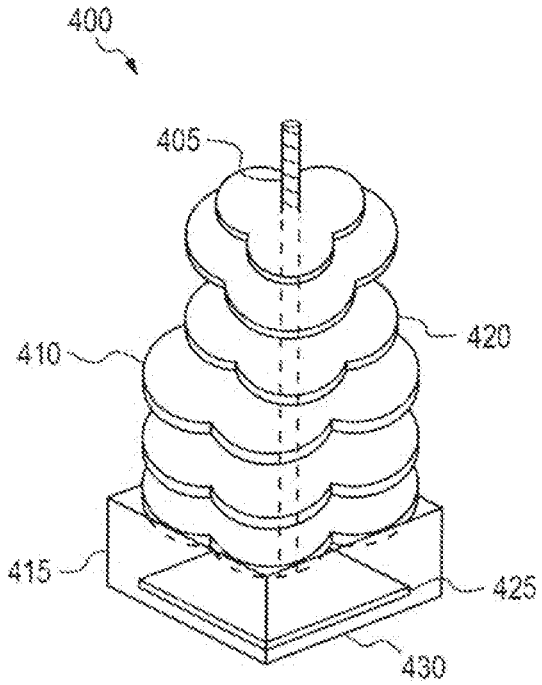
FIG. 5 is a perspective view of an article dispenser with a joining device and a heating element.

FIG. 5 is a perspective view of a dispenser 400 with a joining device 405 and a heating element 425. The dispenser 400 can include a collection of articles arranged in a particular manner as described herein.

Item 405 can be in the form of a pole, rod, adhesive or other similar joining media. The joining device 405 can be attached and/or connected to the heating element 425 to then disperse or transmit heat to the articles surrounding the joining device 405. The joining device 425 or rod for example may have a weighted bottom so as to hold the articles down and keep from falling. In this case the weight then enables tissue to be dispensed from a lower region of the dispenser 400 wherein the heat source 425 is contained only in the bottom compartment. The rod 405 may be of a screw type design in which as one article is released from the top the other articles rise up and the screw form pushes the articles in the direction desired.

Item 410 is the absorbent or nonabsorbent articles. FIG. 5 shows the shape of a flower with edges "carved" or shaped to mimic a more realistic flower. Any shape can be used and the sides may have printed ink to enhance the shape or image. Each of the articles 410 can be printed on the side as well with ink. Each of the articles 410 can have several layers that are of varying shapes and sizes. This allows for the amount or number of articles taken to vary depending on the user's discretion. These articles may be individually wrapped or multiple articles wrapped in a package.

Item 415 is a cover so that the articles can be covered for hygienic purposes or exposed. FIG. 5 illustrates the articles positioned in the form of a shaped flower on the cover 415. The cover 415 can include a heating element 425 in the bottom portion to transmit heat through a metal rod 405 to then heat the tissue 410. This strategy can be used for heating absorbent and nonabsorbent hand towels also. The heat source can be from an electric power source or from commercially made products that heat once exposed to air. Gel type products may also be used once contacted with a user's skin. A drying towel may also be used in conjunction with the wet or gel type heat source. The articles may include a "top down" dispenser in which an article is dispensed at the bottom or near the heat source so as when a user takes an article a weight or other similarly function unit allows for the article to be dispensed again. The cover may be of a transparent or opaque material, completely contain the articles and/or have an appropriate lid or dispensing area. The heating element may extend through the surrounding surface cover area.

The articles 410 can be individually stacked, z-folded, accordion folded or provided in other stacking arrangements. The present subject matter allows for other means of dispensing tissue. The present subject matter can also allow for more items to be stacked for aesthetic flexibility and to not have to constantly refill smaller quantities of packages.

Item 425 is a heating element that can provide warmth to the articles in a safe temperature according to all safety laws. This serves to promote comfort for the user. This heat source can generate heat via electricity, or any other manner such as by heat releasing polymers.

Item 430 is an electrical cord that can transfer electrical power to the heating element.

Figure 6:
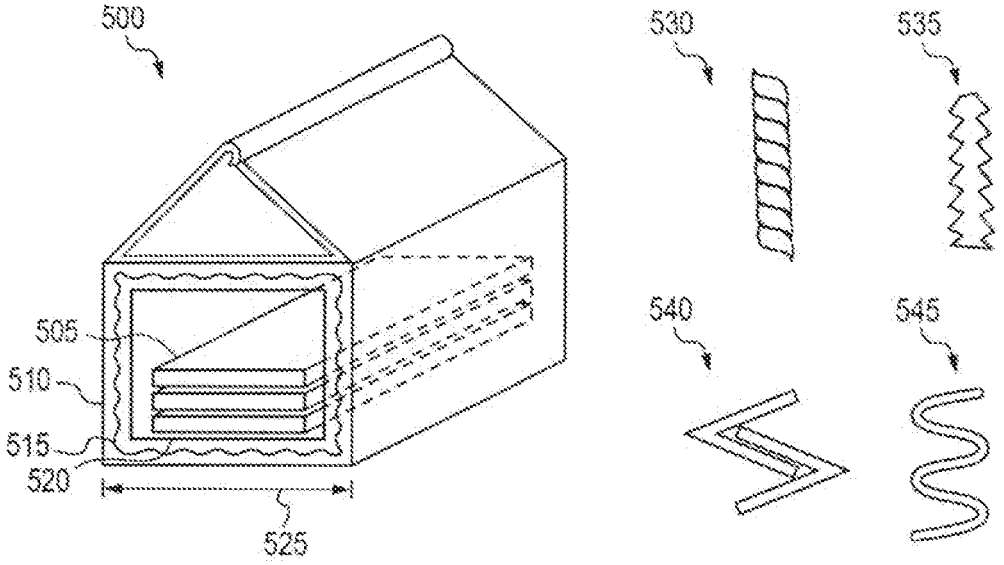
FIG. 6 is a perspective view of a refill package and a heating element.

FIG. 6 is a perspective schematic view of a refill package 500.

Item 505 are the absorbent or nonabsorbent articles individually stacked one on each other. These may have outer packaging for each of the individual packs to refill any of the retaining systems or compartment case(s) described herein. The articles 505 can be placed in any number of carrying compartments or taken individually for any possible chosen substrate, pocket, etc. Any of the articles 505 no matter their size or shape may have outer packaging for each of the individual/dual packs.

Item 510 is a flexible or nonflexible packaging. The packaging 510 may or may not have coordinating features. The packaging 510 can have resealable properties to keep contents of the articles 505 contained and for quantity selection choices. The package 510 may also include or provide the heating element. This may be similar to heating that results from exposure to air, i.e., oxidation reaction, to heat the articles, solar heating capabilities or use of any other commercial heating element.

Item 515 is a heating element. Any combination of heating sources may be used.

Item 520 is an interior side of the package. The interior side 520 can be of any film, polymer, commercial package material, etc.

Item 525 shows a width dimension of the articles being less than the width of currently available articles. This allows for easy filling of any smaller desired compartment or use that is not in the market today as shown in FIGS. 1-5. The width of the refill package may also be larger than those on the market. An example would be the size of a ream of paper allowing the sheet to be folded or not to have folds. Regardless of the size, the use of a relatively small or reduced width allows use of the article without having to unfold the article. This strategy may be implemented for refilling the FIG. 5 refill package.

The refill package 500 may be in the form of a resealable enclosure such as for example in the form of either Press-lok style or similar commercial closure assemblies.

Item 530 is an example of twisted or coiled article that can be individually stacked, z folded, accordion folded, twisted or crumpled or designed into a shape.

Item 535 is an example of a crumpled or shaped article.

Item 540 is an example of a Z folded article that is interlocked with adjacent article(s).

Item 545 is an example of an accordion folded article. The article could be perforated to break away or other separate into multiple sections.

Figure 7:
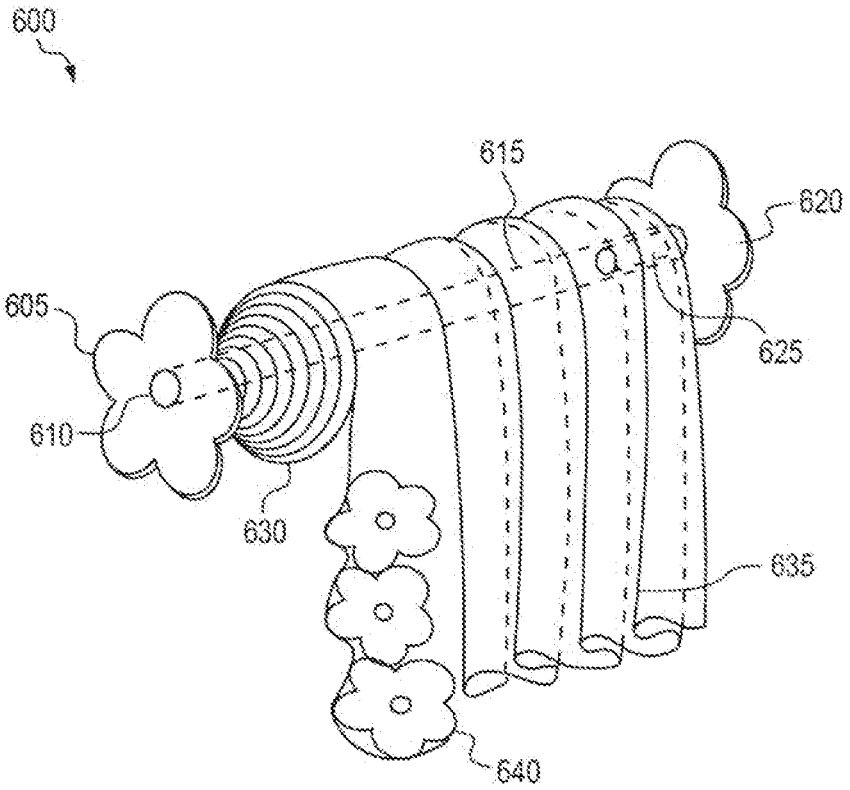
FIG. 7 is a perspective view of a plurality of absorbent articles in roll form with a tapered end face and a roll end cap feature.
Figure 8:
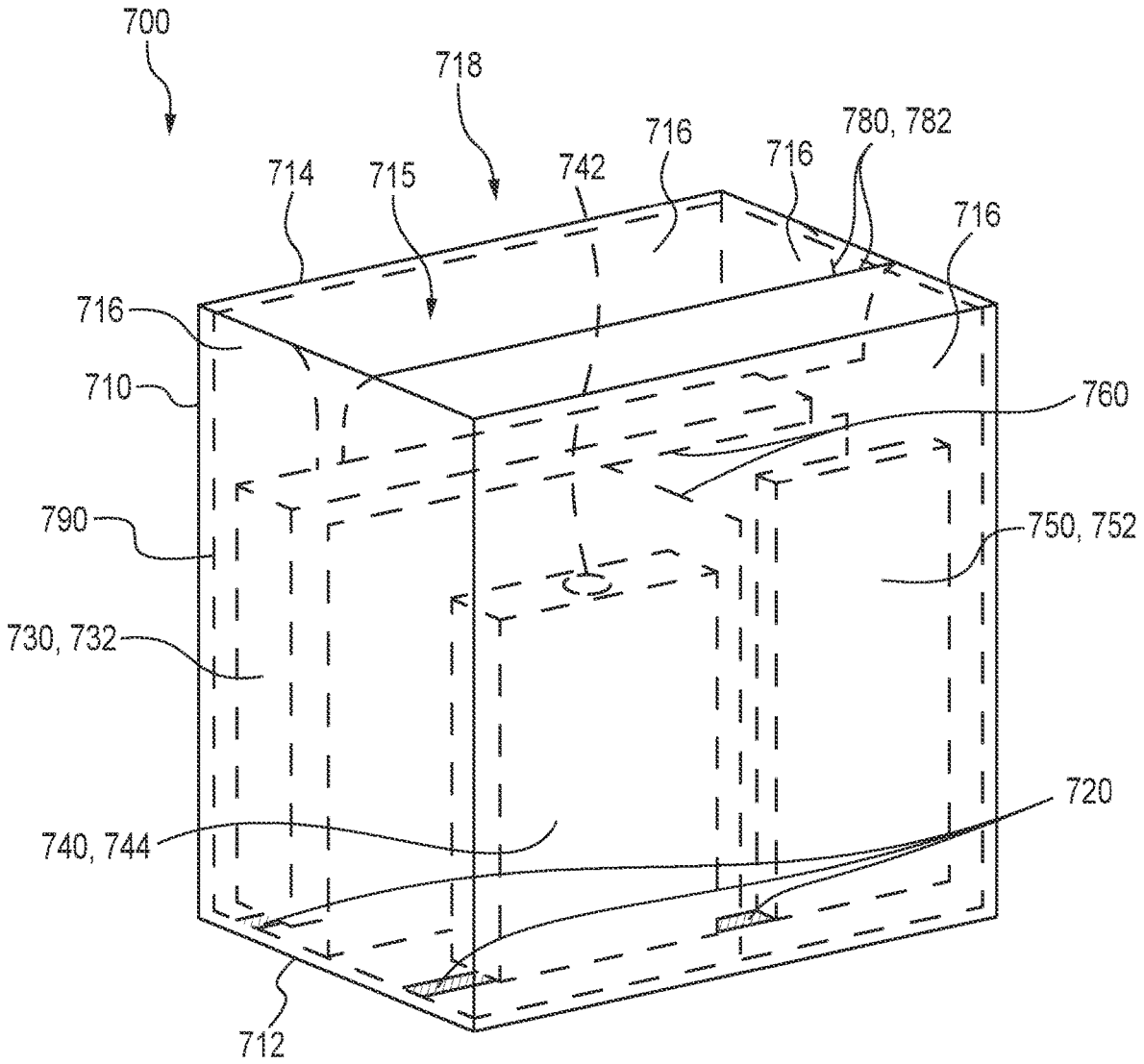
FIG. 8 is a schematic perspective view of a personal care collection kit.

FIG. 7 is a perspective view of a plurality of absorbent articles 600 on a roll such as a toilet tissue roll with an edge shaped into a tapered form instead of a flat end face associated with current rolls on the market. FIG. 7 also shows a roll end cap feature.

The rolled article 600 includes a sheeted material 615 typically in the form of perforated sections of absorbent material, which is wound or rolled about a center member 610. The member 610 can be in the form of a paper or cardboard tube for example. Optional decorative end cap members 605 can be provided on one or both ends of the member 610. The sheeted material 615 is arranged on the center member 610 in a z-fold or accordion style folding arrangement such that the amount of overlapping or folded material increases with the amount of material wound upon the center member 610. Thus, as the material is wound about the member 610, the overall width of the folded layer of material decreases. This folding and winding practice results in the formation of a unique tapered end 630 face of the roll 600. One or more decorative members 640 can also be provided along portions of the sheeted material and/or the roll 600.

In one aspect, the present subject matter provides a collection of products carried on or with a person in a particular enclosure, suitable for inclusion in a bag or purse. The collection comprises (i) a personal product, (ii) a sanitizing substance and (iii) an absorbent material all within a lined pouch or enclosure with a top opening. The lining can be placed within the adjacent substrate such as the enclosure. The personal product, sanitizing substance and absorbent material can be releaseably attached to the inside of a lining.

Personal, hygienic or environmental products are used today but done so separately. For example, users take out sanitizing sprays and gels from a pocket or purse and use them and then they must return the spray or gel product to its original storing location which takes an amount of time. Typically, many people do not use absorbent materials to facilitate faster drying times after using a sanitizer. They usually shake their hands dry or let them air dry naturally which can take a lengthy amount of time before the user can move onto the next task. The present subject matter allows a user to reach into a collection kit and by a one hand motion release contents from an individual or multi use chamber and then dry the user's hand. The interior contents of the enclosure are accessed from a top opening in both a liner and enclosure. The enclosure can have an opening at which is located two flaps. Typically, each flap extends across the opening from a side or top region of the enclosure. For versions using two flaps, typically the flaps extend from opposite sides of the enclosure. To access an interior region of the enclosure, a user applies force with their fingers to separate and move the flaps to their respective sides which then allows the user's hand to enter an inner portion of the enclosure interior. This is accomplished by a one hand motion. The next motion includes the user's fingers depressing a contents container. This container item can be adhered to the side or the bottom of the enclosure interior liner. The contents can be of any gel, liquid, lotion, powder, or solid form for example sanitizer that can be spread or massaged on the hand. The container item can be of a single or multiuse form that can be self-sealing. The user can then easily spread the contents on the hand while the hand is still inside the enclosure. The user can then use an absorbent article also located within the enclosure to wipe their hand dry. The user's hand can be kept within the self-contained enclosure for the entire process. The collection kit can be placed within a pocket, purse, bag, or simply positioned on a surface. This allows the user to hold a phone or keep doing a task with one hand while allowing the other hand to become sanitized, moisturized or the like, and then dried. This personal care collection kit is discreet and effective. The collection kit can be configured as a disposable collection for hygienic purposes with replaceable liners thus allowing the outer enclosure to be reusable. The sanitizer substance and/or absorbent material and similar forms can be individually packaged and retained within the enclosure of the kit and retrieved as needed for use. The collection kit can comprise any of the previously described products, and may include sanitizer, moisturizer, lotion, gel, cream, oil, liquid, etc.

In one embodiment, the collection kit can be placed in a pocket, purse, bag, compartment or similar holding forms. The collection kit can be used most effectively in a pocket and carried directly on a person. This frees a user's hands to do two separate tasks such as cleaning one's hands with this collection and holding a phone, writing or other action with their other hand.

In another embodiment, any of the interior contents can be removed, and used outside of the collection kit for a longer sanitizing, cleaning process if needed. The present subject matter collection kit is especially helpful while one is at a gym working out which typically involves touching and contacting equipment. One could easily use the collection kit for the hands but the kit can also be used when wiping down equipment. A sanitizer and/or towel can be pulled out of a pocket and then easily be placed back into its protected liner again so no wetness or moisture can then leak onto the user or clothing. The absorbent article can be removed from the collection kit individually, while no other packaging or components need to be discarded. The entire liner can be thrown into a receptacle at a later time.

In one embodiment, the collection kit can have an individual, plurality or combination of personal products, substance containers and/or articles suited to a user's needs.

In particular embodiments, the user does not have to place their entire hand in the enclosure. Thus, the size of the enclosure and resulting kit is significantly reduced and thus the amount of waste is reduced.

In one embodiment, the collection kit can be a freestanding unit that serves the needs of households, business or other environments. The collection kit can sit on a sofa table where a guest or worker can easily and quickly clean their hands. The individual packets and articles enable multiple users to use the collection kit without cross contaminating. Individual containers can be removed from within the liner and enclosure and be used independently.

The collection kit can hold other separate personal care items within the interior of the enclosure for a more complete collection. The collection kit can hold other care items for a complete and secure feeling of having everything a user may need.

In one embodiment, the user can have two separate collection kits, one in each pocket. Alternatively, if both hands are in need of cleaning, a user can simply release liquid or gel on one hand, rub it on the other hand and then reach to a collection kit for a quick drying. An absorbent article can be fully retrieved from the collection kit should the user desire to do so.

In another embodiment, the collection kit can include a scent-producing agent thereby allowing a scent to be distributed within the interior of the enclosure and ultimately on the items within the enclosure. The user can then smell the scent as they are being used or when the opening is accessed for a more pleasurable or medicinal use.

The shape of the enclosure and liner can include many different forms suitable to preferences or wishes of users.

In another embodiment, the collection kit can be shared with one or more young family members. Liners along with individual items in the kit can be easily replaced from within the enclosure and then placed in a variety of locations such as a pocket, purse or bag so to be carried at all times depending on the user's location and needs. The enclosure serves as a structural basis of the collection kit as well as a reflection of the owner's personality or likes depicted with printing, embossing or other decorative labels, materials and accessories. The collection kit can be given to young children for their own use ultimately teaching them to be healthy and self-reliant. As children and even adults choose the covering design they are more likely to use the sanitizing contents inside for the purpose of promoting confidence, health and cleanliness.

The present subject matter differentiates itself from other carrying forms such as a purse in that it has a liner that is interchangeable and disposable. The collection kit is housed in a covering that is of lightweight material yet stable enough to hold the liner and its contents. The collection kit is also of a much smaller scale than a typical purse. The typical size of the collection kit is approximately the size of a hand.

Figure 9:
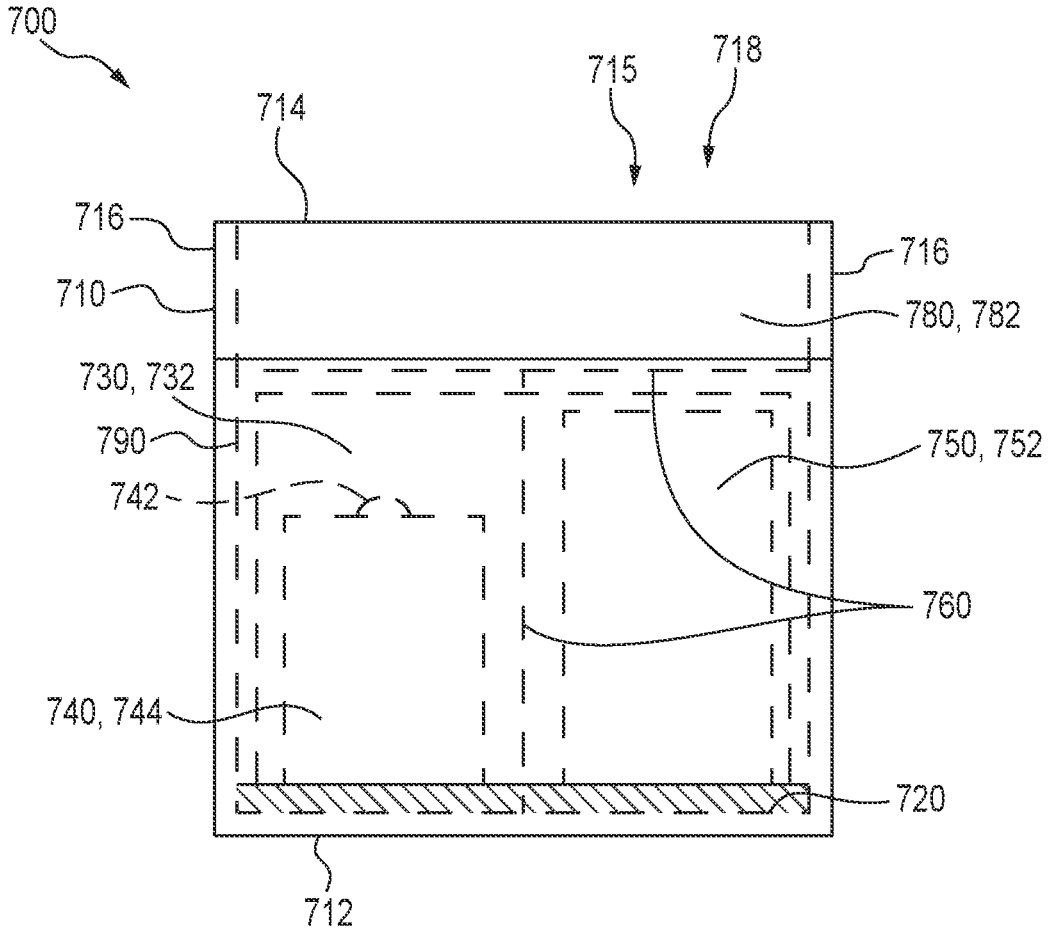
FIG. 9 is a schematic front view of the personal care collection kit of FIG. 8.
Figure 10:
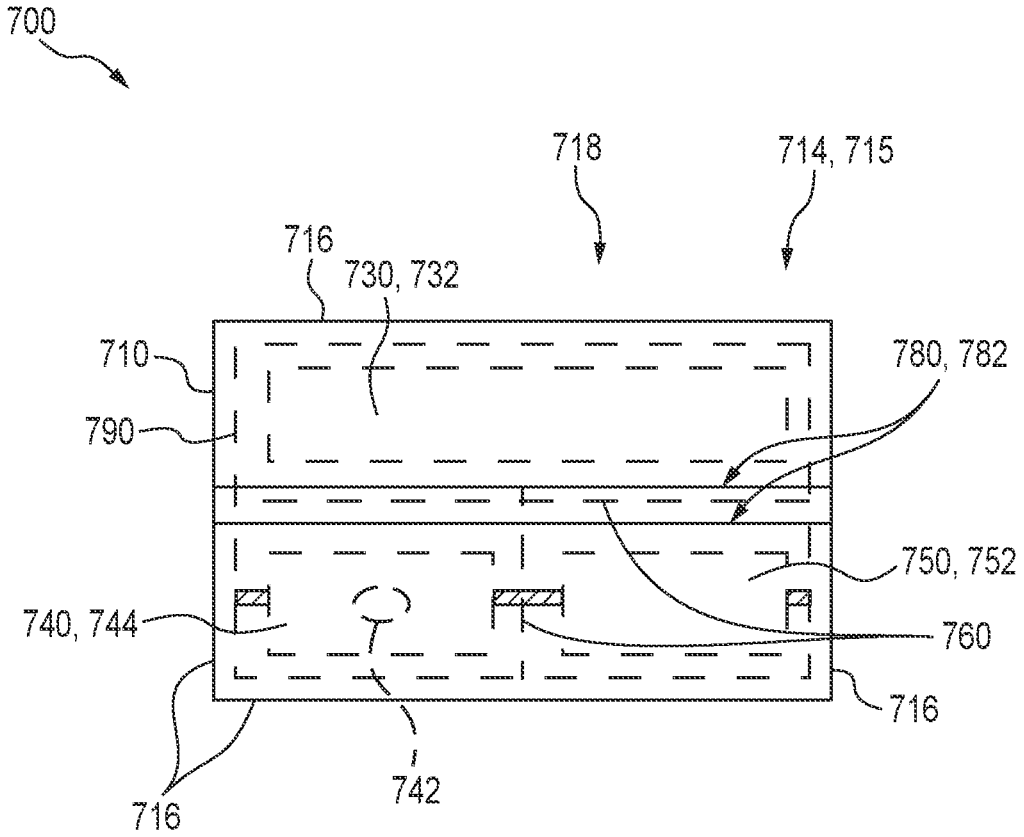
FIG. 10 is a schematic top view of the personal care collection kit of FIG. 8.
Figure 11:
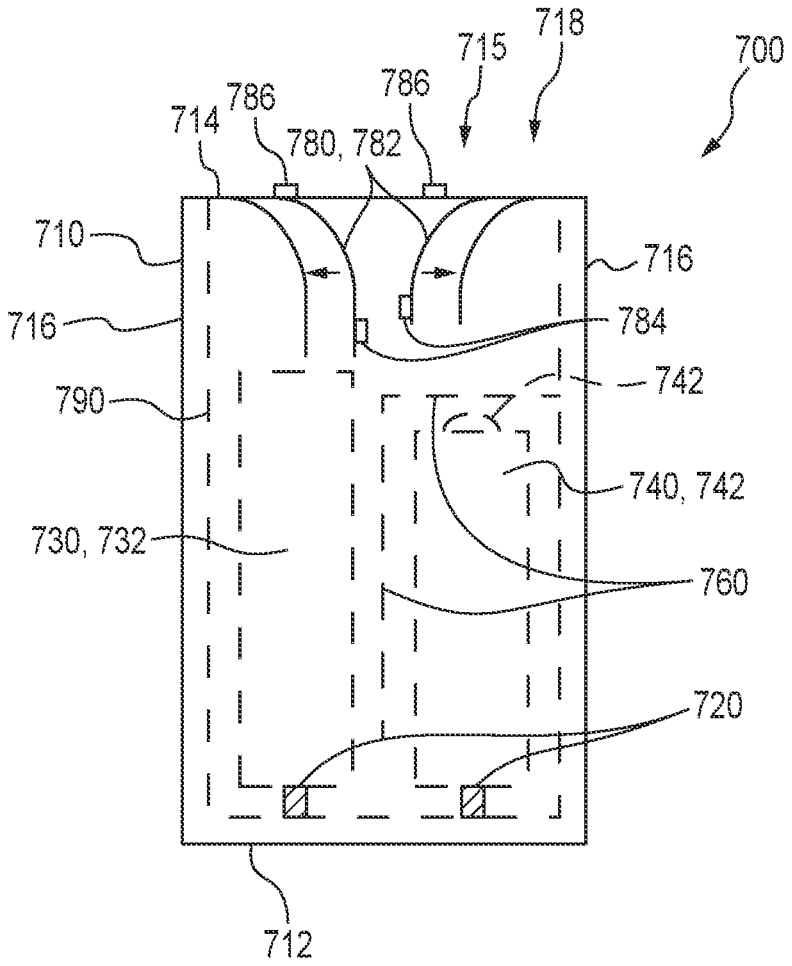
FIG. 11 is a schematic side view of the personal care collection kit of FIG. 8.

FIGS. 8-11 illustrate an embodiment of a personal care collection kit 700. FIG. 9 is a front view of the personal care collection kit 700 in one version comprising an enclosure 710, a personal product 750, an absorbent article 730, and a sanitizer container 740. The enclosure 710 may include one or more flaps 780, 782. The enclosure 700 can be of a plastic, fabric or composite material, and either single or multi-layered containment material that has structure to bear the weight and pressure of contents of its interior components. The kit 700 may include a liner 790 that fits inside the enclosure 710. To release the liner 790, a user simply pulls flaps 780, 782 upward, pulls the liner 790 out of the enclosure 710, replaces a new liner and its contents inside the enclosure 710 and then pushes the flaps 780, 782 down back into the enclosure 710 while the liner 790 stays tucked under a folded edge of one or both flaps 780, 782. This keeps the liner 790 from lifting out of the enclosure 710 when the user retracts their hand and/or other articles. This also keeps the top of the liner 790 from folding or settling downward into the interior of the enclosure 710 when the user applies downward pressure onto the flaps 780, 782, and into the enclosure when gaining access. The user would gain access to the interior of the enclosure 710 by sliding their fingers and then hand past two interior flaps 780, 782 positioned along the open end of the enclosure 710 which keeps the contents of the enclosure 710 contained therein. To access a middle portion of the interior of the enclosure 710, a user pushes down with their fingers to separate and move the flaps 780, 782 to their respective sides which then allows the user's hand to enter the interior portion of the enclosure 710. This can be accomplished by a one hand motion.

Once the hand is inside the enclosure 710, the next motion includes the user's fingers depressing or otherwise applying pressure to a substance container. A self-closing container or package opening can be used in one embodiment. In this version, a user would use their hand to expel sanitizer from a sanitizer container 740. The interior contents of the enclosure 710 typically comprise a personal product 750 such as a tissue, the sanitizer and its container 740, and absorbent article 730, all of which can be attached to a releasable mechanism or adhering element 720 from inside the liner 790. The location of the attachment can vary. Attachment of components can be located on the sidewalls, endwalls, or corners of the interior of the enclosure 710. The present subject matter also includes versions in which the components are not attached within the interior of the enclosure 710, and so are loose. The individual items can simply rest on the bottom of the liner 790 and not adhere to anything. Items can be placed within interior pockets of the enclosure 710 to serve as additional organization within the system. In the referenced figures, the attachment is at the interior bottom face of the enclosure 710 and attaches to the bottom of the personal product, the sanitizer substance container, and the absorbent article. The collection kit 700 can include a barrier 760 that extends along the sidewalls of the enclosure 710 from the flaps 780, 782 to the bottom of the liner 790 reaching across and extending to both sides of the enclosure 710. The enclosure 710 can additionally include a second barrier. There can be zero to additional barriers as needed. A preferred form of the barrier 760 is a nonporous water resistant and/or waterproof material. This allows the wetness or contents of the sanitizer container 740 to not wet or dampen the absorbent article 730 until the user lifts their hand above the barrier 760 while still inside the enclosure 710 and then position their hand over the barrier to utilize the absorbent article and dry their hand with the absorbent article. The user's hand lifts above the barrier 760 but typically stays within the liner 790 and does not lift out of the enclosure 710 completely. In another embodiment, an additional barrier or multiple barriers can be used.

In one embodiment, a fold in the wall of the enclosure or the liner 790 may also serve the purpose of the barrier 760.

More specifically, FIGS. 8-11 illustrate an embodiment of a personal care collection kit 700 in accordance with the present subject matter. The kit 700 comprises an enclosure 710 defining a first endwall 712 and a second endwall or region 714, and a plurality of sidewalls 716 extending between the first and second endwalls 712, 714. The first and second endwalls 712, 714 and the plurality of sidewalls 716 define an interior 718 of the enclosure 710. The second endwall 714 defines an opening 715 providing access to the interior 718 of the enclosure 710.

The personal care collection kit 700 also comprises at least one region of an adhering element 720 disposed along the first endwall 712 and accessible from the interior 718 of the enclosure 710.

The personal care collection kit 700 also comprises at least one absorbent article 730 disposed in the interior 718 of the enclosure 710. The absorbent article 730 is releasably attached to the adhering element 720.

The personal care collection kit 700 also comprises at least one sanitizer container 740 disposed in the interior 718 of the enclosure 710. The sanitizer container 740 is releasably attached to the adhering element 720.

The personal care collection kit 700 also comprises at least one personal product 750 disposed in the interior 718 of the enclosure 710. The personal product 750 is releasably attached to the adhering element 720.

The personal care collection kit 700 also comprises one or more barrier walls 760 disposed in the interior 718 of the enclosure 710. The barrier wall 760 extends between and prevents passage of liquid between each of (i) the at least one absorbent article 730, (ii) the sanitizer container 740, and (iii) the at least one personal product 750.

In certain embodiments, the enclosure 710 includes at least one flexible flap proximate or adjacent the opening 715 defined by the second endwall 714. For example, a first flap 780 and a second flap 782 can be provided. The flaps 780, 782 are positionable between an open position in which the interior 718 of the enclosure 710 is accessible from a location outside of the enclosure 710, and a closed position in which the interior 718 of the enclosure 710 is inaccessible from the location outside of the enclosure. In many versions, one or both of the flaps such as flaps 780, 782 extend across an entirety of the opening 715 defined by the second endwall 714. The flaps such as flaps 780, 782 can include flap securement provisions 784. Such flap securement provisions 784 serve to provide releasable securement between the flaps 780, 782. The enclosure 710 can also include one or more enclosure securement provisions 786 to releasably secure one or more flaps to the enclosure 710. The one or more securement provisions 784 and/or 786 can be in the form of clasps, clips, zippers, hook and loops, buttons and apertures, and nearly any type of fastening provision that enables releasable fastening.

In many embodiments, the enclosure 710 includes a liner 790 disposed in the interior 718 of the enclosure 710 and disposed on the plurality of sidewalls 716 and the first endwall 712. As previously noted, the liner 790 may be easily removable to enable replacement.

In still further embodiments, the absorbent article 730 includes an absorbent article package 732. The absorbent article 730 is disposed within the absorbent article package 732. The absorbent article package 732 can be configured and attached to the adhering element 720 such that the absorbent article 730 can be withdrawn from the absorbent article package 732 and the package 732 remains attached to the adhering element 720.

The sanitizer container 740 includes sanitizer 744, and typically includes a dispensing port 742 for dispensing sanitizer 744 from the sanitizer container 740. Typically, the sanitizer is in liquid form so that it is readily flowable from the sanitizer container 740 through the dispensing port 742.

The personal product 750 can include a personal product package 752. In such versions, the personal product 750 is typically disposed within the personal product package 752. The personal product may exhibit a wide array of forms and configurations. The personal product may be any of the components or products noted herein. Nonlimiting examples of personal products include (i) at least one make-up component, (ii) sunscreen, (iii) cosmetic powder, and (iv) cosmetic lotion.

The personal care collection kit 700 can include a wide array of combinations of components. In one embodiment, the kit 700 comprises two sanitizer containers 740 and one absorbent article 730. In another embodiment, the kit 700 comprises a moist towelette for the absorbent article 730.

An important aspect of the present subject matter is in the comfort level that users gain in knowing they can be prepared for a hygiene emergency. One example is that of an aging population possibly with incontinence issues, sickness, allergies and the like. The emotional and behavioral factors that this present subject matter addresses can make a positive difference in one's life.

The present subject matter also provides systems of multiple packaged absorbent articles. The package is the system for the absorbent articles whereas the package is the coupling component. It is one unit with multiple individual articles that can be easily separated. One outer layer surrounds all articles with each article having the capability of being separated without losing its waterproof or water resistant state. An article and/or article(s) are placed in its own compartment of the outer layer but is still held together by the outer element at the top portion of the entire element along with a joining mechanism for added stability.

The outer layer is then heat sealed, perforated, or separated in any similar fashion and adhered to another adjacent article by an adhering mechanism. They are placed side by side in front to back positioning. This formation is similar to an accordion. The outer package, the interior regions to house the article and the joining mechanism are all one unit. There may be folds which may give the appearance of being separate units but it is all one unit. In certain versions, the package(s) can be provided with a line or region of perforations or weakened material. Providing a line of perforations in the packages, and particularly between adjacent packages if joined together by packaging material, enables a user to easily separate a package from adjacent package(s).

The joining system whereas the top of the package comprises a flexible membrane such as string, flexible plastic, spring, breakable wire or similar fashioned material and mechanism. This membrane goes through the top region of the package which gives the outer package its strength. It also allows for the mechanism to be released and then the individual articles can be broken off to the desired quantity. This joining mechanism allows for attachment to other articles. It is a flexible unit. The article may also have a heavier or thicker or strengthened portion to hold this mechanism and the unit as one.

This accordion style formation of articles allows the system to be carried in a relatively compact state. They may also be vacuum packed as well to decrease its size. This also allows for manufacturing ease whereas the outer wall is all one system. They can be held together tightly with the assistance of the top joining mechanism or loosely with the top joining mechanism released yet still attached until broken off or separated with some type of force. They can be all attached to one another so no articles can slip away from its entirety unless manipulated to do so. Many individual units today allows for them to fall away from one another or another compartment type element is needed to keep them together in one location.

The adhesion element is on the outer face of the individual units' flexible wall. This allows for easy separation with little force to separate one article from another. It assists in keeping the lower section of the articles in the accordion style. The adhesion may be in a perforation type form where only certain areas of the faces are in a connected state.

The adhering mechanism is multipurpose. It assists in keeping the articles together. The units end piece may also serve as an attachment element for the entire unit. It can attach to a piece of clothing or ring or other article with an adhering mechanism such as a clamp, crimper, twist tie or similar joining member. The unit itself as a whole which is a flexible adhering mechanism which can then wrap itself around another item. It is flexible yet will hold its shape when bent.

The releasing mechanism can be a twist tie, spring, string, flexible plastic or other similar material to facilitate a loosening and tightening effect to then be able to release the article quantity needed. An example of the releasing mechanism is an element that lies at the first closed end of the article, extends through all the attached articles and or its outer packaging and then finishes at the last article. It allows for the entire unit of multiple articles to be loosened, article amounts to be released and then allows for the system to be tightened again so no articles are released unless it is intentioned to do so.

To release the article from the interior package a user can use a pull or inherent membrane. This can be a one step process. The article can be beautifully flower shaped to enhance the experience of using a tissue or other article. The article is in a folded up state whereas more thickness can be beneficial to the user in that it provides more layers of protection while using and less fussing by the user to get proper coverage. The article can easily be opened to its full capacity size with a simple shake of the wrist or hand. This force will spread the article open to its near full size.

The article may also be released from inside by using a push through method in the lower portion for sanitary purposes. There are no small pieces of packaging debris left behind. The medical community will benefit most as well those trying to keep any sickness, bacterial, viral or any other unclean material away from the articles containment.

Because the article can be vacuum packed it is one of the most discreet articles. Others in the market place are not vacuum packed and one must carry 5-10 tissues at a time as that is how they are sold or presented. One article of this system can be carried at a time if desired.

The individual articles can be attached to each other or to other surfaces. A plastic removable tab can be removed to expose an adhering membrane that then attaches the articles outer and inner contents to almost anywhere. There will be no damage to the surface it is placed on and no residue left behind. A user simply removes with one's fingers.

This waterproof or water resistant article can utilize a sliding mechanism to ensure the articles dryness. Outdoorsmen or outdoor athletes will certainly appreciate this aspect.

Utilizing nano science the outer packaging will be lighter in weight again making it more discreet and waterproof or water resistant at the same time. This science will also apply to scent, lotion, antibacterial, medicinal, heat or any other related embellishments to make the experience of using a tissue more enjoyable and useful. This allows the scent to be inherent and not a spray, wax or gel. The use of this holds the scent for an extended period of time and there is no time exhaustion waiting for scent to be airborne infused during manufacturing.

In the various systems comprising a plurality of flexible packages as described herein, each package typically comprises a first closed end, a second end opposite the first end, and one or more flexible package walls that extend between the first and second ends. In certain versions, the second end of the package(s) can include provisions for accessing the interior region of the package. Nonlimiting examples of such provisions include a pull tab or a resealable sliding member. Other forms of closures or sealable members, including both resealable and non-resealable forms can be utilized. Nonlimiting examples of representative packages include item 35 in FIG. 1, item 100 in FIG. 2, and item 345 in FIG. 4.

Generally, each package as previously described herein, defines an interior region within which is disposed one or more articles as described herein. In many embodiments the articles are absorbent articles as noted herein and can be for example tissues, wipes, towels, napkins, and the like. A representative example of an absorbent article is item 125 in FIG. 2. Each package can contain a scent-producing agent, which typically is incorporated in the article. The articles can include indicia or designs printed on the article. The articles can also include one or more embossed patterns formed in the article.

In certain versions of the systems comprising a plurality of flexible packages, the system can also comprise one or more flexible reinforcement members extending between the first end of each of the packages to thereby couple each package to an adjacent package. The flexible reinforcement member also serves to couple each package to a remaining position of the plurality of packages. The flexible reinforcement member can be in a wide array of forms but is typically a flexible member such as a twist tie, a spring or spring-like member, a wire, a string, or a flexible plastic member. A nonlimiting example of a flexible reinforcement member is shown in FIG. 1 as coupling component 15. Combinations of various members or components can be used. The flexible reinforcement member couples, affixes, or at least retains the plurality of packages together until a user desires to separate one or more packages from the others. The flexible reinforcement member may be in the form of a closed loop. Alternatively, the flexible reinforcement member may include provisions for selectively opening and then closing the loop, such as for example if a user wishes to remove one or more packages from the others. The present subject matter also includes configurations in which the packages are removed or separated from the flexible reinforcement member by selectively releasable engagement provisions on the package. It is also contemplated that if the flexible reinforcement member extends through aperture(s) in the package(s), a package could be pulled from the flexible reinforcement member to thereby fracture or tear the package wall.

The flexible reinforcement member typically couples or retains each of the packages by passing through one or more apertures defined in the package. The present subject matter includes versions in which the flexible reinforcement member is coupled to package(s) by use of mechanical components. It is also contemplated that adhesive(s) could be used to couple or affix the flexible reinforcement member to the packages.

In certain versions of the system comprising a plurality of flexible packages, the system can also comprise a joining means for coupling each package to an adjacent package. In many versions the joining means is used in combination with the flexible reinforcement member. Typically, the joining means is a component or portion(s) of the package material that extends between the flexible wall of one package to the flexible wall of adjacent package(s). In certain embodiments, the joining means extends between an outer face of the flexible wall of one package to an outer face of the flexible wall of another or adjacent package(s). In particular embodiments, the joining means extends through an aperture defined in the flexible wall of the package and additionally extends through an aperture defined in the flexible wall of another or adjacent package(s). For example, the joining means could be an extension of the package material which provides mechanical affixment between adjacent packages. The joining means could also be for example in the form of a member such as a region of adhesive, portion of flexible reinforcement member, or combinations thereof that extend between regions of adjacent packages typically at locations away from the first ends of the packages. The joining means can take other forms such as any described herein or shown in the accompanying figures. It is also contemplated that for versions in which the joining means is an extension of the package material, a line of perforations can be provided in that extension portion for separating package(s).

A significant feature of the systems comprising a plurality of flexible packages relates to particular orientations of the collection of packages. In many embodiments, the plurality of flexible packages are aligned with each other such that the first end of each flexible package is disposed alongside the first end of adjacent flexible package(s), and the second end of each flexible package is disposed alongside the second end of adjacent flexible package(s). In many embodiments, including that noted immediately above, the plurality of flexible packages are further aligned such that a front face of a first package is directed toward a rear face of an immediately adjacent second package; and a front face of the second package is directed toward a rear face of an immediately adjacent third package. This particular arrangement is repeated throughout the entire plurality of packages. However, it will be understood that the present subject matter includes other arrangements and orientations for the plurality of packages. It will also be understood that in many versions, the noted arrangement(s) and orientation(s) of the plurality of packages are maintained by the flexible reinforcement member and/or the joining means described herein. These particular arrangements and orientations of the plurality of packages promote ease of use and convenience for a user.

In the noted systems, one or more adhesives can be used such as for example pressure sensitive adhesives. Typically, such adhesives are disposed on an outer face of the flexible wall of one or more packages. The use of such adhesives enable a package, and/or the entirety of the system, to be conveniently adhered to a surface of interest.

In one aspect, the present subject matter provides a system for retaining and individually dispensing disposable absorbent articles. The system comprises a plurality of flexible packages in which each package defines a hollow interior and encloses and retains an absorbent article disposed in the package interior. Each package includes (i) a first closed end, (ii) a second end opposite the first end, the second end including provisions for accessing the interior of the package, and (iii) a flexible wall extending between the first end and the second end. The flexible wall defines an outer face. The system also comprises a joining means for coupling each package to an adjacent package. The plurality of flexible packages are aligned with each other such that the first end of each flexible package is disposed alongside the first end of adjacent flexible packages and the second end of each flexible package is disposed alongside the second end of adjacent flexible packages.

In another aspect, the present subject matter provides a system for retaining and individually dispensing disposable absorbent articles. The system comprises a plurality of flexible packages, each package defining a hollow interior, each package including (i) a first closed end, (ii) a second end opposite the first end, the second end including provisions for accessing the hollow interior of the package, and (iii) a flexible wall extending between the first end and the second end thereby defining the hollow interior of the package. The flexible wall further defines an outer face. The system also comprises a plurality of absorbent articles. Each article is disposed in a corresponding hollow interior of a package. Each article is selected from the group consisting of a tissue, a wipe, a towel, and a napkin. The system also comprises a flexible reinforcement member extending between the first end of each of the packages of the plurality of flexible packages to thereby couple each package to the flexible reinforcement member and to a remaining portion of the plurality of packages. The plurality of flexible packages are aligned with each other such that the first end of each flexible package is disposed alongside the first end of adjacent flexible packages and the second end of each flexible package is disposed alongside the second end of adjacent flexible packages.

In still another aspect, the present subject matter provides a system for retaining and individually dispensing disposable absorbent articles. The system comprises a plurality of flexible packages, each package including (i) a first closed end, (ii) a second end opposite the first end, and (iii) a flexible wall extending between the first end and the second end, each package defining an interior region. Each package includes provisions for accessing the interior region of the package. The provisions are selected from the group consisting of a pull tab and a releasable sliding member. The system also comprises a plurality of absorbent articles. Each article is disposed in an interior region of a corresponding package. Each article is selected from the group consisting of a tissue, a wipe, a towel, and a napkin. The system also comprises a flexible reinforcement member extending between the first end of each of the packages of the plurality of packages to thereby (i) couple each package to an adjacent package, (ii) couple each package to the flexible reinforcement member, and (iii) couple each package to a remaining portion of the plurality of packages. The flexible reinforcement member is selected from the group consisting of a twist tie, a spring, a string, and a flexible plastic member. The system additionally comprises a joining means for further coupling each package to an adjacent package. The joining means extends between the flexible wall of a package to the flexible wall of an adjacent package. The system further comprises a receptacle for housing the plurality of flexible packages. The plurality of flexible packages are aligned with each other such that the first end of each flexible package is disposed alongside the first end of adjacent flexible packages and the second end of each flexible package is disposed alongside the second end of adjacent flexible packages.

In many embodiments, a retaining system for a collection of absorbent articles such as tissues, wipes, towels, cloths, napkins, or similar materials or combinations thereof is described. The articles can be packaged or unpackaged, and held together with a coupling component. The retaining system also includes one or more accessory articles attached to the coupling component. The retaining system may also include an optional waste receptacle attached to the coupling component.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A personal care collection kit comprising:

an enclosure defining a first endwall and a second endwall, and a plurality of sidewalls extending between the first and second endwalls, the first and second endwalls and the plurality of sidewalls defining an interior of the enclosure, the second endwall defining an opening providing access to the interior of the enclosure, wherein the enclosure includes at least two flexible flaps proximate the opening defined by the second endwall, the flaps positionable between an open position in which the interior of the enclosure is accessible from a location outside of the enclosure, and a closed position in which the interior of the enclosure is inaccessible from the location outside of the enclosure;

at least one region of an adhering element disposed along the first endwall and accessible from the interior of the enclosure;

at least one absorbent article disposed in the interior of the enclosure, the absorbent article releasably attached to the adhering element;

at least one sanitizer container disposed in the interior of the enclosure, the sanitizer container releasably attached to the adhering element;

at least one personal product disposed in the interior of the enclosure, the personal product releasably attached to the adhering element;

a barrier wall disposed in the interior of the enclosure, the barrier wall extending between and preventing passage of liquid between each of (i) the at least one absorbent article, (ii) the sanitizer container, and (iii) the at least one personal product;

a liner disposed in the interior of the enclosure and disposed on the plurality of sidewalls and the first endwall;

wherein the liner is replaceable by positioning the two flexible flaps to the open position and pulling the liner out of the enclosure and the liner is retained in the enclosure by positioning the two flexible flaps to the closed position.

2. The personal care collection kit of claim 1 wherein the two flexible flaps extend across the entire opening defined by the second endwall.

3. The personal care collection kit of claim 1 wherein the absorbent article includes an absorbent article package and the absorbent article is disposed within the absorbent article package.

4. The personal care collection kit of claim 3 wherein the absorbent article package is configured and attached to the adhering element such that the absorbent article can be withdrawn from the absorbent article package and the absorbent article package remains attached to the adhering element.

5. The personal care collection kit of claim 1 wherein the sanitizer container includes a dispensing port for dispensing sanitizer from the sanitizer container.

6. The personal care collection kit of claim 5 wherein the sanitizer is liquid.

7. The personal care collection kit of claim 1 wherein the personal product includes a personal product package and the personal product is disposed within the personal product package.

8. The personal care collection kit of claim 7 wherein the personal product is selected from the group consisting of (i) at least one make-up component, (ii) sunscreen, (iii) cosmetic powder, and (iv) cosmetic lotion.

9. The personal care collection kit of claim 1 wherein the two flexible flaps are releasably secured to each other by flap securement provisions.

10. The personal care collection kit of claim 1 wherein at least one of the flexible flaps is releasably secured to the enclosure by enclosure securement provisions.

11. The personal care collection kit of claim 1 wherein the kit comprises two sanitizer containers, and one absorbent article.

12. The personal care collection kit of claim 1 wherein the absorbent article is a moist towelette.

* * * * *